US012796744B2

(12) United States Patent
Kuai et al.

(10) Patent No.: US 12,796,744 B2
(45) Date of Patent: Nov. 17, 2026

(54) AEROSOL-GENERATING SYSTEM AND AEROSOL-GENERATING DEVICE

(71) Applicant: SHENZHEN FIRST UNION TECHNOLOGY CO., LTD., Shenzhen (CN)

(72) Inventors: Supeng Kuai, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 415 days.

(21) Appl. No.: 18/293,788

(22) PCT Filed: Aug. 2, 2022

(86) PCT No.: PCT/CN2022/109781
§ 371 (c)(1),
(2) Date: Jan. 31, 2024

(87) PCT Pub. No.: WO2023/011499
PCT Pub. Date: Feb. 9, 2023

(65) Prior Publication Data

US 2024/0251880 A1 Aug. 1, 2024

(30) Foreign Application Priority Data

Aug. 2, 2021 (CN) ..... 202110881136.8

(51) Int. Cl.
*A24F 40/85* (2020.01)
*A24F 40/20* (2020.01)
(Continued)

(52) U.S. Cl.
CPC ..... *A24F 40/85* (2020.01); *A24F 40/20* (2020.01); *A24F 40/465* (2020.01); *A24F 40/485* (2020.01)

(58) Field of Classification Search
CPC ..... A24F 40/20; A24F 40/46; A24F 40/40; A24F 40/85; A24F 40/465; A24F 40/485; A24F 40/90
See application file for complete search history.

(56) References Cited

U.S. PATENT DOCUMENTS

| | | | |
|---|---|---|---|
| 2018/0168224 | A1 | 6/2018 | Naughton et al. |
| 2020/0359682 | A1 | 11/2020 | Han et al. |
| 2021/0112878 | A1 | 4/2021 | Ruscio et al. |

FOREIGN PATENT DOCUMENTS

| | | | |
|---|---|---|---|
| CN | 208523783 | U | 2/2019 |
| CN | 211048399 | U | 7/2020 |

(Continued)

*Primary Examiner* — Elizabeth L Mckane
(74) *Attorney, Agent, or Firm* — PROI Intellectual Property US

(57) ABSTRACT

This application provides an aerosol-generation device, configured to heat an aerosol-generating product to generate an aerosol. The aerosol-generation device includes: a receiving cavity, configured to receive the aerosol-generating product; a heater, at least partially extending in the receiving cavity, to heat the aerosol-generating product, where the heater has a free front end configured to be inserted into the aerosol-generating product; and a window, at least partially surrounding the heater and avoiding the free front end, to cause the heater to have an exposed portion exposed through the window, where a user cleans the exposed portion of the heater through the window. With the foregoing aerosol-generation device, it is conducive to cleaning a part of the heater facing away from the free front end through the window during use.

17 Claims, 17 Drawing Sheets

(51) Int. Cl.
*A24F 40/465* (2020.01)
*A24F 40/485* (2020.01)

(56) References Cited

FOREIGN PATENT DOCUMENTS

| | | | | |
|---|---|---|---|---|
| CN | 211065069 | U | | 7/2020 |
| CN | 212117073 | U | | 12/2020 |
| CN | 213587421 | U | | 7/2021 |
| CN | 215958316 | U | | 3/2022 |
| CN | 216147259 | U | | 4/2022 |
| CN | 216147260 | U | | 4/2022 |
| CN | 216701662 | U | | 6/2022 |
| WO | WO 2019/214008 | | * | 11/2019 |
| WO | 2020193206 | A1 | | 10/2020 |
| WO | 2021139785 | A1 | | 7/2021 |

* cited by examiner

AEROSOL-GENERATING SYSTEM AND AEROSOL-GENERATING DEVICE

CROSS-REFERENCE TO RELATED APPLICATIONS

This application claims priority to international Application No. PCT/CN2022/109781 which claims priority to Chinese Patent Application No. 202110881136.8, filed with the China Intellectual Property Administration on Aug. 2, 2021 and entitled "AEROSOL-GENERATION SYSTEM AND AEROSOL-GENERATION DEVICE", which is incorporated herein by reference in its entirety.

TECHNICAL FIELD

Embodiments of this application relate to the field of heat not burning cigarette device technologies, and in particular, to an aerosol-generation system and an aerosol-generation device.

BACKGROUND

Tobacco products (such as cigarettes, cigars, and the like) burn tobacco during use to produce tobacco smoke. Attempts are made to replace these tobacco-burning products by making products that release compounds without burning.

An example of this type of products is a heating apparatus that releases compounds by heating rather than burning materials. For example, the materials may be tobacco or other non-tobacco products. These non-tobacco products may include or not include nicotine. As another example, there are aerosol-providing products, for example, electrically heating smoking devices.

SUMMARY

Embodiments of this application provide an aerosol-generation device, configured to heat an aerosol-generating product to generate an aerosol, including:

- a receiving cavity, configured to receive the aerosol-generating product;
- a heater, at least partially extending in the receiving cavity, to heat the aerosol-generating product, where the heater has a free front end configured to be inserted into the aerosol-generating product; and
- a window, at least partially surrounding the heater and avoiding the free front end, to cause the heater to have an exposed portion exposed through the window, where a user cleans the exposed portion of the heater through the window.

In a preferred implementation, a distance between the exposed portion of the heater and the free front end is greater than 8 mm. In a specific implementation, a distance between the exposed portion of the heater and the free front end is 12 mm.

In a preferred implementation, the window has a size feature, and the size feature prevents a finger of the user from being in contact with the heater through the window.

In a preferred implementation, an area of the window ranges from 10 $mm^2$ to 100 $mm^2$. Preferably, an area of the window ranges from 30 $mm^2$ to 80 $mm^2$.

In a preferred implementation, the window is configured in a shape of a strip extending in a width direction of the aerosol-generation device.

In a preferred implementation, the window has a length size and a width size, and at least one of the length size and the width size is not greater than 10 mm. Preferably, at least one of the length size and the width size is not greater than 6 mm.

In a preferred implementation, a length size of the window ranges from 10 mm to 20 mm; and/or a width size of the window ranges from 3 mm to 6 mm.

In a preferred implementation, the exposed portion of the heater is located outside the receiving cavity.

In a preferred implementation, the exposed portion of the heater has a length approximately ranging from 2 mm to 5 mm.

In a preferred implementation, the aerosol-generation device further includes: a fixing base, configured to keep the heater, where the exposed portion is close to or terminates at the fixing base.

In a preferred implementation, the aerosol-generation device includes a front side and a rear side that are opposite to each other in a thickness direction; and the window is at least partially located on the front side and/or the rear side.

In a preferred implementation, the aerosol-generation device includes a left side and a right side that are opposite to each other in a width direction; and the heater is adjacent to the right side, and the window is at least partially located on the right side.

In a preferred implementation, further including: a door cover, movably coupled to the aerosol-generation device at a first position and a second position, where the door cover covers the window at the first position, and exposes the window at the second position.

In a preferred implementation, the door cover simultaneously covers the window and the receiving cavity at the first position, and simultaneously exposes the window and the receiving cavity at the second position.

In a preferred implementation, further including:

a bracket, at least partially defining the window.

In a preferred implementation, further including:

a blocking member, configured to block the window.

In a preferred implementation, the blocking member is removably combined with the bracket, blocks the window when combined with the bracket, and exposes the window when removed from the bracket.

In a preferred implementation, the blocking member is configured to be removable from the bracket in a width direction of the aerosol-generation device.

In a preferred implementation, when the blocking member is combined with the bracket, the blocking member is flatly joined to an outer surface of the bracket.

In a preferred implementation, further including:

a guide rail, configured to provide guidance when the blocking member is combined with the bracket or is removed from the bracket.

In a preferred implementation, the blocking member includes:

- a main body portion, configured to be removably combined with the bracket; and
- at least one blocking arm, extending from the main body portion in a width direction of the aerosol-generation device, and configured to cover the window.

In a preferred implementation, the bracket has a recessed portion, and the main body portion is further combined with the bracket after being accommodated in the recessed portion.

In a preferred implementation, a first magnetic member is arranged on the bracket; and a second magnetic member is arranged on the main body portion, to be magnetically attracted to the first magnetic member when the blocking member is combined with the bracket.

In a preferred implementation, the blocking member is movably combined with the bracket, and is configured to selectively block or expose the window through movement.

In a preferred implementation, further including:

an electric core, where an extending length thereof in a length direction of the aerosol-generation device at least partially coincides with the heater; and a cavity, located between the electric core and the heater in a width direction of the aerosol-generation device, to reduce heat transferred from the heater to the electric core.

In a preferred implementation, the bracket includes: an inner wall, at least partially surrounding the heater; and an outer side wall, adjacent to the electric core, where the cavity is formed between the inner wall and the outer side wall of the bracket.

In a preferred implementation, the bracket is configured to be removable from the aerosol-generation device, to basically completely expose the heater.

In a preferred implementation, the receiving cavity is in airflow communication with the window, so that external air enters the receiving cavity through the window during inhalation.

In a preferred implementation, further including:

an extractor, selectively configurable from an operating position to an extraction position, and configured to extract the aerosol-generating product, where the aerosol-generating product is in contact with the heater when the extractor is at the operating position, and the aerosol-generating product is separated from the heater when the extractor is at the extraction position;

a third magnetic member is arranged on the extractor, and is configured to be magnetically attached to the first magnetic member at the operating position; and in a length direction of the aerosol-generation device, a magnetic pole direction of the first magnetic member, a magnetic pole direction of the second magnetic member, and a magnetic pole direction of the third magnetic member are the same.

In a preferred implementation, further including:

an extractor, selectively configurable from an operating position to an extraction position, and configured to extract the aerosol-generating product, where the aerosol-generating product is in contact with the heater when the extractor is at the operating position, and the aerosol-generating product is separated from the heater when the extractor is at the extraction position;

the extractor is at least partially exposed through the window at the operating position.

In a preferred implementation, further including:

an extractor, selectively configurable from an operating position to an extraction position, and configured to extract the aerosol-generating product, where the aerosol-generating product is in contact with the heater when the extractor is at the operating position, and the aerosol-generating product is separated from the heater when the extractor is at the extraction position;

the extractor covers the exposed portion of the heater at the operating position.

Still another embodiment of this application further provides an aerosol-generation device, configured to heat an aerosol-generating product to generate an aerosol, including:

a receiving cavity, configured to receive the aerosol-generating product;

a heater, at least partially extending in the receiving cavity, to heat the aerosol-generating product, where the heater has a free front end configured to be inserted into the aerosol-generating product; and a window, at least partially surrounding the heater and avoiding the free front end, where at least a part of the heater facing away from the free front end is visible through the window.

An aerosol-generation device, configured to heat an aerosol-generating product to generate an aerosol, including:

a receiving cavity, configured to receive the aerosol-generating product;

a heater, at least partially extending in the receiving cavity, to heat the aerosol-generating product, where the heater has a free front end configured to be inserted into the aerosol-generating product; and a window, at least partially surrounding the heater and avoiding the free front end, where the window is configured as an air inlet for air to enter the receiving cavity during use.

With the foregoing aerosol-generation device, it is conducive to cleaning a part of the heater facing away from the free front end through the window during use.

BRIEF DESCRIPTION OF THE DRAWINGS

One or more embodiments are exemplarily described with reference to the corresponding figures in the accompanying drawings, and the descriptions are not to be construed as limiting the embodiments. Elements in the accompanying drawings that have same reference numerals are represented as similar elements, and unless otherwise particularly stated, the figures in the accompanying drawings are not drawn to scale.

DETAILED DESCRIPTION

For ease of understanding of this application, this application is described in further detail below with reference to the accompanying drawings and specific implementations.

An embodiment of this application provides an aerosol-generation device, configured to receive an aerosol-generating product to generate an aerosol.

Further, in an optional implementation, an aerosol-generating product preferably uses a tobacco-containing material that releases volatile compounds from a substrate when being heated; or may also be a non-tobacco material that may be adapted to be electrically heated for smoking after being heated. The aerosol-generating product preferably uses a solid substrate, which may include one or more powders, granules, fragments, thin strips, strips, or flakes of one or more of vanilla leaves, tobacco leaves, homogenized tobacco, and expanded tobacco; or a solid substrate may include additional tobacco or non-tobacco volatile flavor compounds that are released when the substrate is heated.

Further, in an optional implementation, the aerosol-generating product includes cigarettes in a shape of a slender cylinder.

Figure 1:
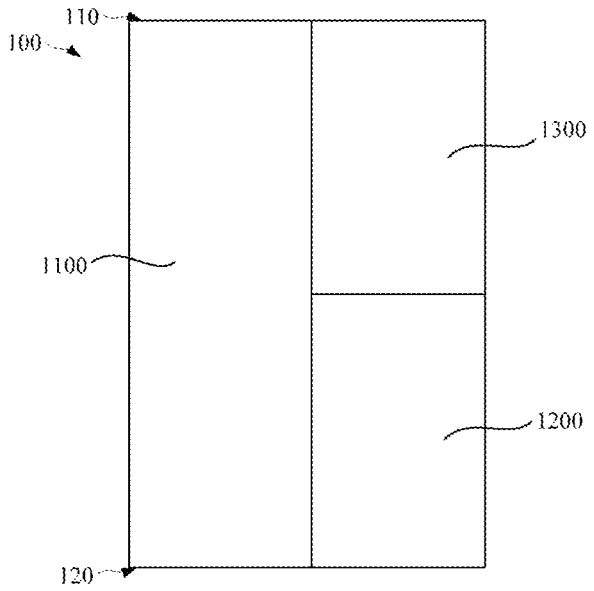
FIG. 1 is a schematic diagram of an aerosol-generation device according to an embodiment.
Figure 2:
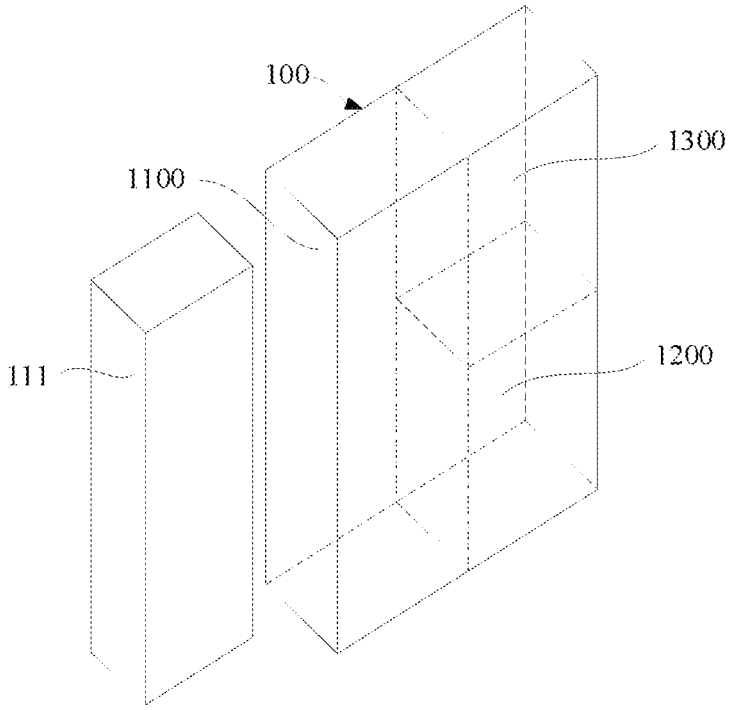
FIG. 2 is an exploded schematic diagram of an aerosol-generation device from still another perspective.

Further, refer to FIG. 1 and FIG. 2, in one embodiment, the aerosol-generation device 100 is configured to have a generally square shape.

In the implementation shown in FIG. 1, the aerosol-generation device 100 includes:

a near end 110 and a far end 120 that are opposite to each other in a length direction, where according to requirements of normal use, the near end 110 is configured as an end for a user to inhale an aerosol. During use, the aerosol-generating product is at least partially received into the aerosol-generation device 100 through the near end 110 and is heated to generate the aerosol.

Further, refer to FIG. 1 and FIG. 2, the aerosol-generation device 100 defines:

a first space 1100, basically extending from the near end 110 to the far end 120, where the first space 1100 is located on a side of the aerosol-generation device 100 in a width direction; and during use, the first space 1100 is a space used to accommodate and assemble an electric core 111 for power supply;

a second space 1200, basically located at a position close to the far end 120, and being opposite to or adjacent to a part of the first space 1100 in the width direction, where during use, the second space 1200 is a space used to accommodate and assemble a circuit board, such as a PCB board; and a third space 1300, basically located at a position close to the near end 110, being opposite to the second space 1200 in a length direction, and being opposite to or adjacent to the part of the first space 1100 close to the near end 110 in the width direction, where during use, the third space 1300 is an at least partially defined heating space, to receive and heat at least a part of the aerosol-generating product, to generate an aerosol for inhaling.

In a preferred implementation, the first space 1100, the second space 1200, and the third space 1300 are basically airtightly sealed from each other, to prevent hot air or the aerosol from flowing in front of the first space 1100, the second space 1200, and the third space 1300.

Figure 3:
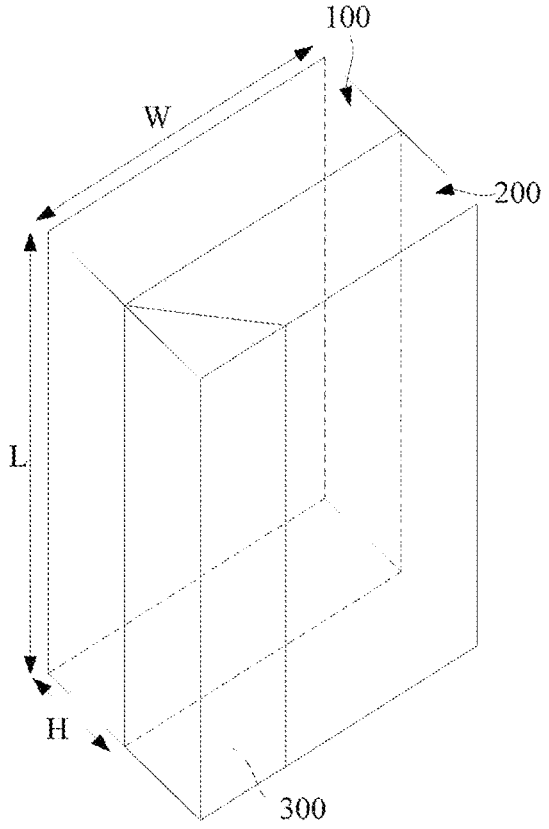
FIG. 3 is a schematic diagram of combination of an aerosol-generation device and a product box according to an embodiment.

Further, FIG. 3 is a schematic diagram of an aerosol-generation system including an aerosol-generation device 100 and a product box 200. As shown in FIG. 3, the product box 200, such as a cigarette box, is usually configured in a shape of a square; and the product box 200 usually has an openable flip cover 300, and by opening the flip cover 300, the aerosol-generating product, such as cigarettes, accommodated inside the product box 200 may be accessed.

Further, as shown in FIG. 3, the aerosol-generation device 100 basically has a shape and a volume size that are similar to that of the product box 200 such as the cigarette box. Therefore, it is conducive to being placed in combination with the product box 200.

Further, as shown in FIG. 3, an outer surface of the aerosol-generation device 100 has several planes, and a plane with a greatest area is planar side surface located on two sides in a thickness direction; and the product box 200, such as a cigarette box, also has a planar side surface located on two sides in the thickness direction, which is the plane with the greatest area. When a side surface of the aerosol-generation device 100 in the thickness direction is combined with a side surface of the product box 200 in the thickness direction, a contact area between a side surface of the aerosol-generation device 100 in the thickness direction and a side surface of the product box 200 in the thickness direction is defined by the smaller plane of the two.

Certainly, in some implementations, an area or a shape of the largest plane on the outer surface of the aerosol-generation device 100 is basically the same as or close to an area or a shape of the largest plane on the outer surface of the product box 200. Alternatively, in some implementations, an area or a shape of any side surface of the aerosol-generation device 100 in the thickness direction is basically the same as or close to an area or a shape of any side surface of the product box 200 in the thickness direction.

In addition, as shown in FIG. 3, the side surface of the aerosol-generation device 100 that is in contact with or is in combination with the product box 200 is in a shape of a square; any other side surfaces of the aerosol-generation device 100 adjacent to the side surface in contact with the product box 200 are in a shape of a square; and for example, the side surfaces of the aerosol-generation device 100 in FIG. 3 in the length direction or the width direction are all in a shape of a square.

In addition, as shown in FIG. 3, when the aerosol-generation device 100 is combined with the product box 200 in the thickness direction, the side surface of the aerosol-generation device 100 facing away from the product box 200 in the thickness direction, and the side surface of the product box 200 facing away from the aerosol-generation device 100 are exposed. During use, a user may simultaneously keep the side surface of the aerosol-generation device 100 facing away from the product box 200 in the thickness direction with fingers, and the side surface of the product box 200 facing away from the aerosol-generation device 100 simultaneously keeps the aerosol-generation device 100 and the product box 200; and this is advantageous for portability.

As shown in FIG. 3, the aerosol-generation device 100 and the product box 200 basically have similar shapes, sizes, and volumes. In an implementation, the product box 200 has a length size approximately ranging from 70 mm to 80 mm, a width size approximately ranging from 40 mm to 50 mm, and a thickness size approximately ranging from 10 mm to 20 mm.

According to FIG. 3, the corresponding aerosol-generation device 100 may have a length L approximately ranging from 70 mm to 80 mm, a width W approximately ranging from 40 mm to 50 mm, and a thickness H approximately ranging from 9.5 mm to 20 mm. In an implementation, surfaces on two sides of the aerosol-generation device 100 in the thickness direction are the planes with the greatest area, and the area approximately ranges from 2800 $mm^2$ to 4000 $mm^2$.

Further, in some optional implementations, an extending length/thickness of the first space 1100 is basically close to a length L/thickness H of the aerosol-generation device 100. A width of the first space 1100 is between ⅓ and ⅔ of a width W of the aerosol-generation device 100; and more preferably, a width of the first space 1100 is basically close to ½ of the width W of the aerosol-generation device 100. In some implementations, the first space 1100 also has a length size approximately ranging from 60 mm to 65 mm, a width size approximately ranging from 15 mm to 25 mm, and a thickness size approximately ranging from 5 mm to 10 mm.

Correspondingly, as shown in FIG. 2, the electric core 111 accommodated or assembled in the first space 1100 is configured to be basically in a shape of a square. Correspondingly, in some implementations, a volume or a shape of the electric core 111 is basically the same as or similar to a volume or a shape of the first space 1100. In some implementations, the electric core 111 has a length approximately ranging from 60 mm to 65 mm, a width approximately ranging from 15 mm to 25 mm, and a thickness approximately ranging from 5 mm to 10 mm.

Further, in some optional implementations, the second space 1200 has a length size approximately ranging from 35 mm to 50 mm, a width size ranging from 15 mm to 25 mm, and a thickness size approximately ranging from 5 mm to 10 mm.

Further, in some optional implementations, the third space 1300 has a length size approximately ranging from 25 mm to 40 mm, a width size ranging from 15 mm to 25 mm, and a thickness size approximately ranging from 5 mm to 10 mm.

In some other implementations, a width of the second space 1200 and/or the third space 1300 is between ⅓ and ⅔ of the width W of the aerosol-generation device 100; and more preferably, a width of the second space 1200 and/or the third space 1300 is basically close to ½ of the width W of the aerosol-generation device 100.

A thickness of the second space 1200 and/or the third space 1300 is basically close to the thickness H of the aerosol-generation device 100.

In some other implementations, an extending length of the second space 1200 is greater than an extending length of the third space 1300. In some other implementations, the extending length of the second space 1200 is between ½ and ⅔ of the length of the aerosol-generation device 100. In some other implementations, the extending length of the third space 1300 is between ⅓ and ½ of the length of the aerosol-generation device 100.

Figure 4:
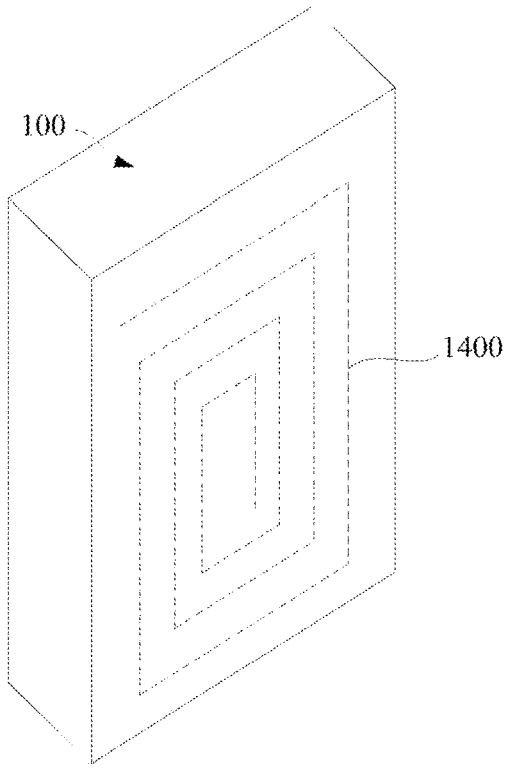
FIG. 4 is a schematic diagram of an aerosol-generation device according to still another embodiment.

Further, as shown in FIG. 4, in still another optional implementation, a wireless charging coil 1400 close to at least one side in a thickness direction is arranged in the aerosol-generation device 100; and the wireless charging coil 1400 may be configured to be couple to an external wireless charging device, and then receive electromagnetic energy of the wireless charging device to generate a charging current to charge the electric core 111.

Further, as shown in FIG. 4, the wireless charging coil 1400 configured to wirelessly charge the electric core 111 is a planar spiral coil. In some implementations, the wireless charging coil 1400 is a generally planar spiral coil in a shape of a square, as shown in FIG. 4. Alternatively, in some implementations, the wireless charging coil 1400 may be further configured as a planar spiral coil in a shape of a circle.

In some optional implementations, the wireless charging coil 1400 is made of a wire material with a cross section in a shape of a circle or a rectangle; and the wire material includes, for example, a common copper wire, a nickel wire, and the like. Alternatively, in some other optional implementations, the planar spiral coil of the wireless charging coil 1400 is in the form of a deposited, printed, or etched coating, track, or line; and for example, the wireless charging coil 1400 is in the form of a planar spiral coil with a coating or circuit made of a conductive material by printing and depositing on a substrate. Alternatively, in some other optional implementations, the planar spiral coil of the wireless charging coil 1400 is in the form of a planar spiral coil formed by etching or cutting a piece of metal conductive substrate.

Figure 5:
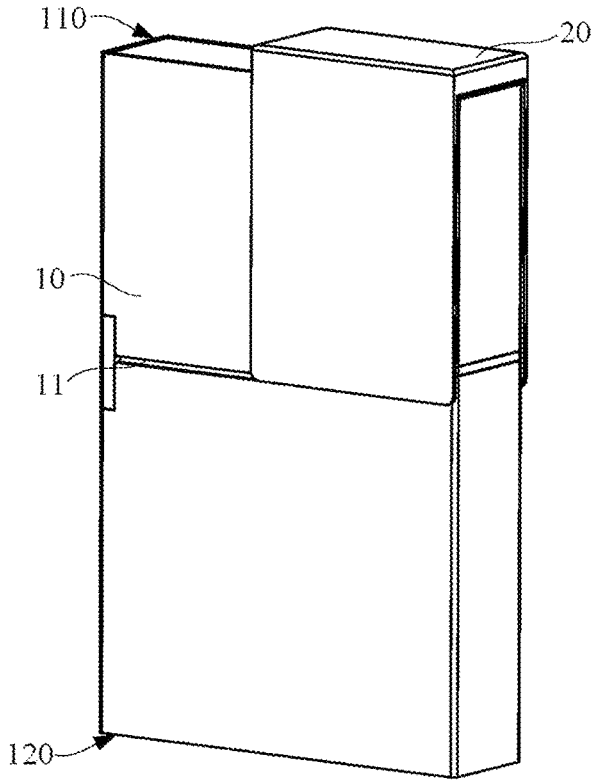
FIG. 5 is a schematic diagram of a specific structure of an embodiment of an aerosol-generation device in FIG. 1.
Figure 6:
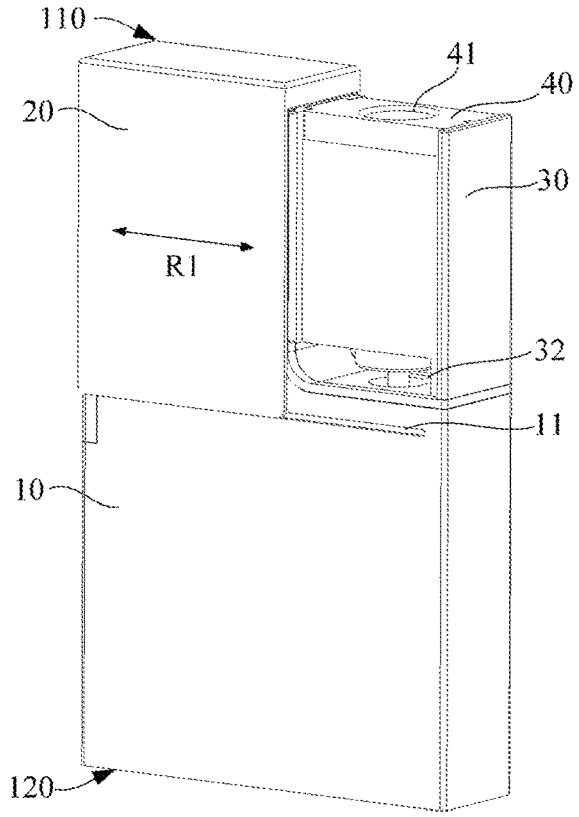
FIG. 6 is a schematic diagram of a structure of a door cover in FIG. 5 moving to open a heating assembly.
Figure 7:
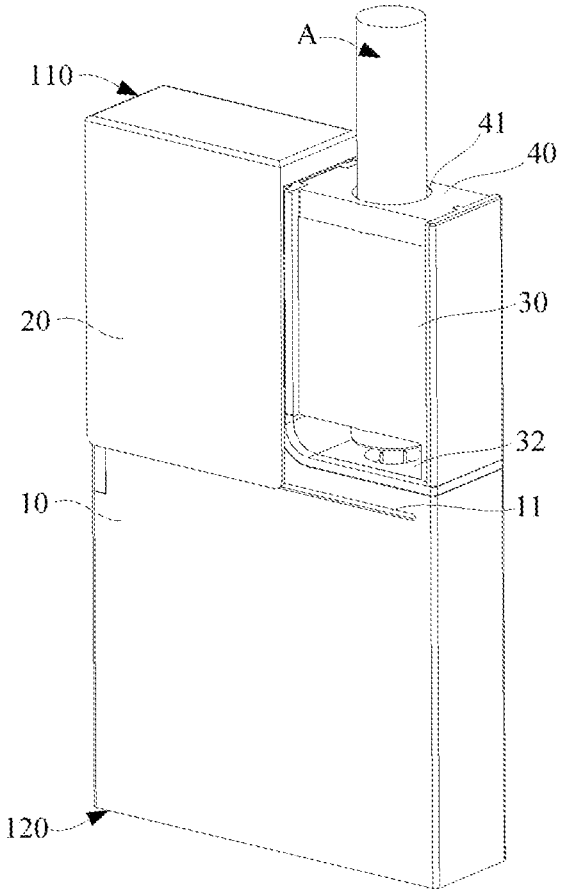
FIG. 7 is a schematic diagram of a use state of an aerosol-generation device in FIG. 6 from one perspective.

Further, FIG. 5 to FIG. 7 show a schematic diagram of an aerosol-generation device 100 of a specific embodiment. In this embodiment, the aerosol-generation device 100 includes:

- a main housing 10, where the main housing 10 mainly serves as a housing component of the aerosol-generation device 100, and further defines a first space 1100, a second space 1200, and a third space 1300 inside the main housing 10; and therefore, in an implementation, the main housing 10 generally has requirements of a shape and a size of the aerosol-generation device 100 described above; and
- a door cover 20, located at a near end 110 of the main housing 10 and/or the aerosol-generation device 100, and being configured to be movable relative to the main housing 10 in an implementation, where certainly, according to the preferred embodiment shown in FIG. 5 and FIG. 6, movement of the door cover 20 relative to the main housing 10 is sliding in a width direction of the main housing 10, as shown by the arrow R1 in FIG. 6; or in other variation implementations, movement of the door cover 20 relative to the main housing 10 may be in the form of rotation around a specific axis.

As shown in FIG. 5 to FIG. 7, the door cover 20 is designed to move, so that the door cover 20 has an open position and a closed position. When the door cover 20 is at the closed position, for example, as shown in FIG. 5, the door cover 20 blocks or seals the third space 1300. In this case, the aerosol-generation device 100 is locked and cannot be used; and when the door cover 20 is at the open position, for example, as shown in FIG. 6 and FIG. 7, the third space 1300 is exposed, and then a user may receive an aerosol-generating product A into the aerosol-generation device 100 for inhaling, and clean the third space 1300.

Further, as shown in FIG. 5 to FIG. 7, a guide groove 11 is provided on the main housing 10, and is configured to provide guidance for a movement process of the door cover 20. Specifically, in a preferred implementation, the guide groove 11 is provided on a side surface of the main housing 10 in a thickness direction; and the guide groove 11 is configured as a slender groove extending in a width direction of the main housing 10. During use, the door cover 20 at least partially extends into the guide groove 11, thereby engaging with the guide groove 11 to form guide for a movement process; and positions of end portions at two ends of the guide groove 11 are used to limit the movement of the door cover 20.

In the implementation shown in the figure, the guide groove 11 has a length approximately ranging from 30 mm to 40 mm.

Figure 8:
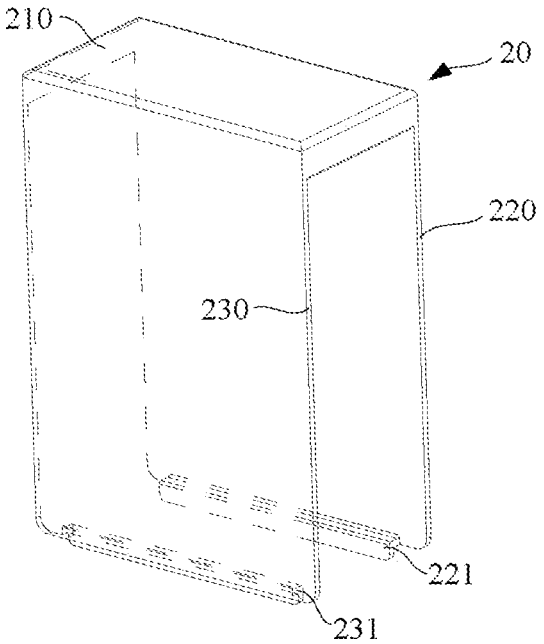
FIG. 8 is a schematic diagram of a structure of a door cover from still another perspective.

For a shape or a structure of the door cover 20, refer to FIG. 8. The door cover 20 includes:

- a first blocking wall 210, basically parallel to an upper side surface of the main housing 10, where the third space 1300 is blocked or closed at a near end 110 when in a use state at the closed position; and
- a second blocking wall 220 and a third blocking wall 230, extending in a length direction of the main housing 10, where the second blocking wall 220 and the third blocking wall 230 are connected to the first blocking wall 210 at the near end 110. The second blocking wall 220 and the third blocking wall 230 are separately arranged on two sides of the main housing 10 in a thickness direction; and further, during use, the second blocking wall 220 and the third blocking wall 230 separately block or seal the third space 1300 from two sides of the main housing 10 in a thickness direction.

Further, a first hook 221 is arranged at an end portion of the second blocking wall 220 facing away from the first blocking wall 210, and/or a second hook 231 is arranged at an end portion of the third blocking wall 230 facing away from the first blocking wall 210; and during use, the first hook 221 and/or the second hook 231 at least partially extend into the guide groove 11, to provide guidance while remaining connected to the main housing 10, thereby preventing the first hook 221 and/or the second hook 231 from protruding from the guide groove 11 and causing the door cover 20 to fall off from the main housing 10.

In the preferred implementation shown in FIG. 8, the first blocking wall 210 and/or the second blocking wall 220 and/or the third blocking wall 230 are in a shape of a rectangle. In a more preferred implementation, the first blocking wall 210 has a length size approximately ranging from 15 mm to 25 mm and a width size approximately ranging from 5 mm to 10 mm. In addition, the second blocking wall 220 and/or the third blocking wall 230 have a length size approximately ranging from 28 mm to 40 mm, and a width size approximately ranging from 15 mm to 25 mm.

In a more preferred implementation, the door cover 20 is made of a highly heat conductive material, such as a metal material, which is conducive to promoting heat dissipation of a heating assembly in the third space 1300 and evenly transferring heat to other parts.

Further, refer to FIG. 6 and FIG. 7, the aerosol-generation device 100 includes:

- a receiving hole 41, located at a near end 110, where an aerosol-generating product A may be at least partially received in the aerosol-generation device 100 through the receiving hole 41.

Figure 10:
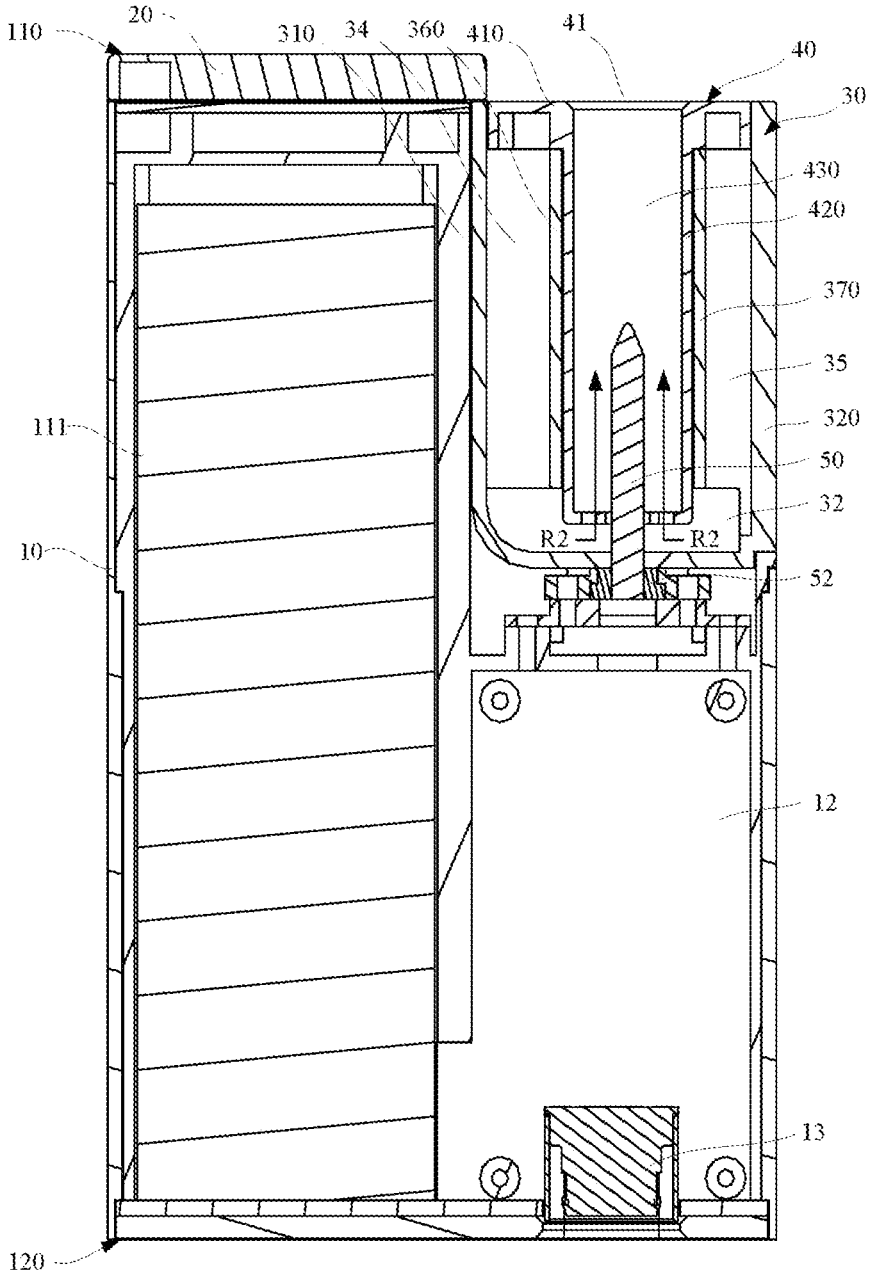
FIG. 10 is a schematic cross-sectional view of the aerosol-generation device in FIG. 6.

In the preferred implementation shown in FIG. 10, the receiving hole 41 is defined by an extractor 40. Alternatively, in other variation implementations, when the aerosol-generation device 100 does not have the extractor 40, the receiving hole 41 may be further defined by a main housing 10 or a bracket 30, or the like.

In addition, refer to FIG. 10, correspondingly, the aerosol-generation device 100 includes:

- a receiving cavity 430, where at least a part of the aerosol-generating product A is removably received in the receiving cavity 430; and the receiving cavity 430 is in communication with the receiving hole 41.

In the preferred implementation shown in FIG. 10, the receiving cavity 430 is also defined by the extractor 40. Alternatively, in other variation implementations, when the aerosol-generation device 100 does not have the extractor 40, the receiving cavity 430 may be further defined by a main housing 10 or a bracket 30, or the like.

Figure 9:
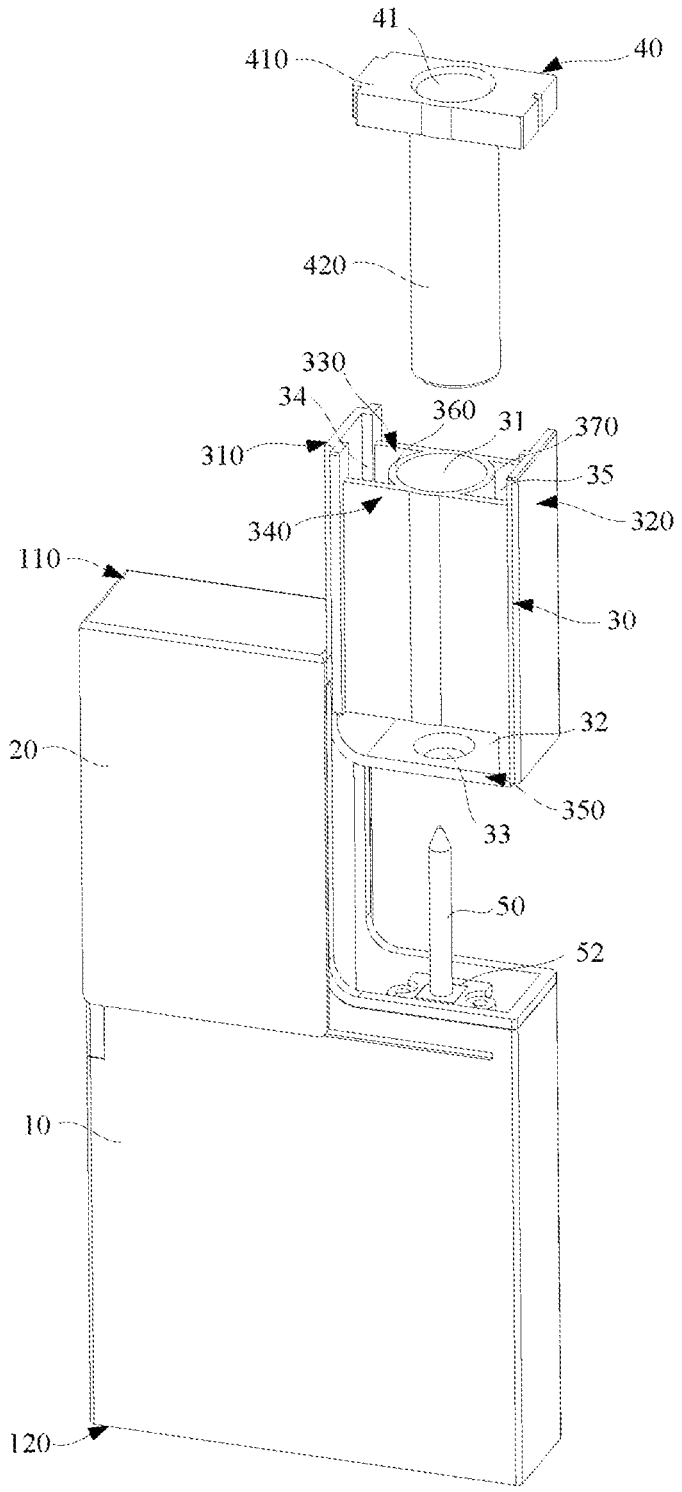
FIG. 9 is an exploded schematic diagram of each part of the aerosol-generation device in FIG. 6.

Further, refer to FIG. 9 and FIG. 10, the aerosol-generation device 100 includes:

- a heater 50, configured in a shape of a pin, a needle, a sheet, and the like, such as a shape of a needle shown in FIG. 9; and when the aerosol-generating product A is received in the aerosol-generation device 100, the heater 50 may be inserted into the aerosol-generating product A for heating. In some optional implementations, the pin-shaped or needle-shaped heater 50 has a length size approximately ranging from 12 mm to 19 mm and an outer diameter size approximately ranging from 2 mm to 5 mm. In some other optional implementations, the sheet-shaped heater 50 may have a length size approximately ranging from 12 mm to 19 mm, a width size approximately ranging from 3 mm to 6 mm, and a thickness size approximately ranging from 0.4 mm to 1 mm. Accordingly, as shown in FIG. 10, the heater 50 at least partially extends in the receiving cavity 430, thereby being conducive to being inserted into the aerosol-generating product A for heating.

In other variation embodiments, the heater 50 may be further configured in a shape of a cylinder; and during use, an internal space of the heater 50 defines to form the receiving cavity 430 for receiving the aerosol-generating product A and generating an aerosol by heating a periphery of the aerosol-generating product A.

In some optional implementations, the heater 50 is a resistance heater; or Alternatively, in some implementations, the heater 50 is a susceptor that is penetrated by a magnetic field and generates heat.

Further, refer to FIG. 9 and FIG. 10, the aerosol-generation device 100 includes:

- a bracket 30, configured to support the extractor 40 in an implementation. In addition, the bracket 30 is further configured to surround or block the heater 50 to protect the heater 50. Specifically,
- on one hand, the bracket 30 is arranged in the third space 1300 in a detachable manner. When the extractor 40 is connected to the aerosol-generation device 100, the extractor 40 is supported or kept by the bracket 30. On the other hand, if the bracket 30 at least partially surrounds or blocks the heater 50, the heater 50 may at least be prevented from being completely exposed in the third space 1300, which is conducive to preventing the user from being in contact with or touching the heater 50.

In a preferred implementation, the bracket 30 generally has a shape of a square. In an implementation, specifically, the bracket 30 has a length size approximately ranging from 25 mm to 40 mm, a width size ranging from 15 mm to 25 mm, and a thickness size approximately ranging from 5 mm to 10 mm.

Further, refer to FIG. 9 and FIG. 10, the extractor 40 includes:

a receiving portion 420 in a shape of a cylinder, where an internal space of the receiving portion 420 is configured as a receiving cavity 430 configured to receive the aerosol-generating product A; and an operating portion 410, where during use, the user operates the operating portion 410 to move or remove the extractor 40 and extract the aerosol-generating product A by operating the operating portion 410 with a finger, or the like. When the extractor 40 is assembled in the aerosol-generation device 100, the operating portion 410 is connected to the main housing 10, so that the extractor 40 is stably kept on the aerosol-generation device 100. Certainly, in some implementations, the operating portion 410 may be directly or indirectly connected to the main housing 10. Alternatively, in the preferred implementation shown in FIG. 9 and FIG. 10, the operating portion 410 is fixed and kept in the aerosol-generation device 100 by abutting against and being connected to an upper end portion of the bracket 30.

Figure 11:
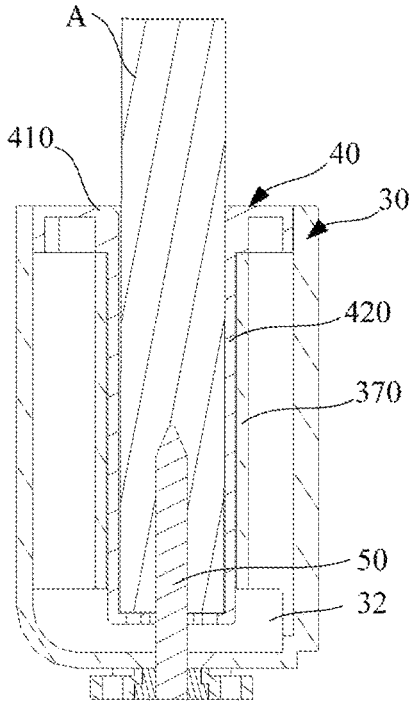
FIG. 11 is a schematic diagram of an extractor in FIG. 10 in an operating state.

Further, in a more preferred implementation, the extractor 40 may be moved or removed relative to the main housing 10, to present an operating position and an extraction position that are opposite to each other. Specifically, FIG. 11 is a schematic diagram of an extractor 40 at an operating position according to an embodiment. When the extractor 40 is at the operating position, an aerosol-generating product A is received in a receiving portion 420, and is supported by a supporting wall 421 of the receiving portion 420; and the heater 50 at least partially penetrates into a receiving cavity 430 defined by the receiving portion 420 through the supporting wall 421, thereby heating the aerosol-generating product A. The operating position is basically an operating position formed by the heater 50 being inserted into the aerosol-generating product A. At the operating position, the extractor 40 remains connected to a main housing 10.

Figure 12:
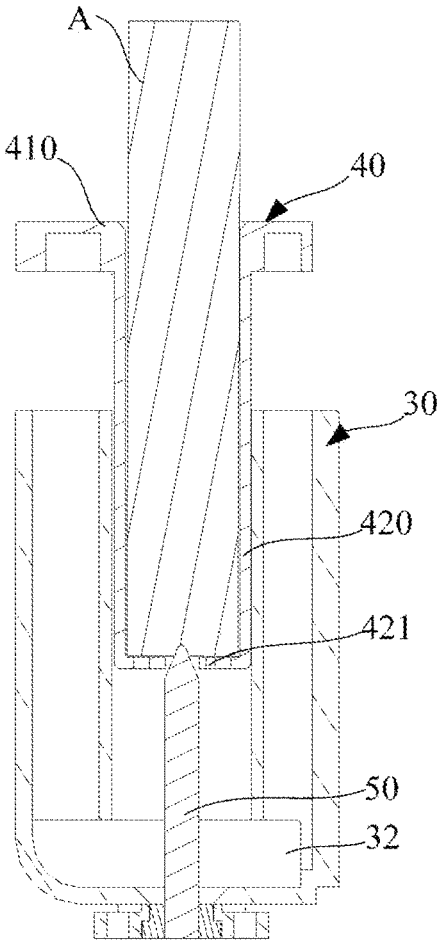
FIG. 12 is a schematic diagram of the extractor in FIG. 11 in an extraction state.

FIG. 12 is a schematic diagram of an extractor 40 at an extraction position according to an embodiment. At the extraction position, when an operating portion 410 performs operation, the extractor 40 is moved or removed in a length direction relative to a main housing 10, and then an aerosol-generating product A is separated from a heater 50 under support of a supporting wall 421 and is removed. The extraction position is formed by separation between the aerosol-generating product A and the heater 50.

In an optional implementation, the extractor 40 is also directly or indirectly connected to the main housing 10 at the extraction position, which is conducive to preventing the extractor 40 from being detached from the aerosol-generation device 100. Alternatively, in still another optional implementation, the extractor 40 is not directly or indirectly connected to the main housing 10 at the extraction position, and then the extractor 40 is detached from the main housing 10 and/or the bracket 30 at the extraction position, thereby facilitating direct removal or detachment from the aerosol-generation device 100.

In an optional implementation, the aerosol-generating product A has a length approximately ranging from 40 mm to 80 mm, and an outer diameter size approximately ranging from 4 to 8 mm.

In still another preferred implementation, the receiving portion 420 of the extractor 40 has a length approximately ranging from 15 mm to 40 mm; and the receiving portion 420 correspondingly has an inner diameter approximately ranging from 4 mm to 8 mm.

Figure 13:
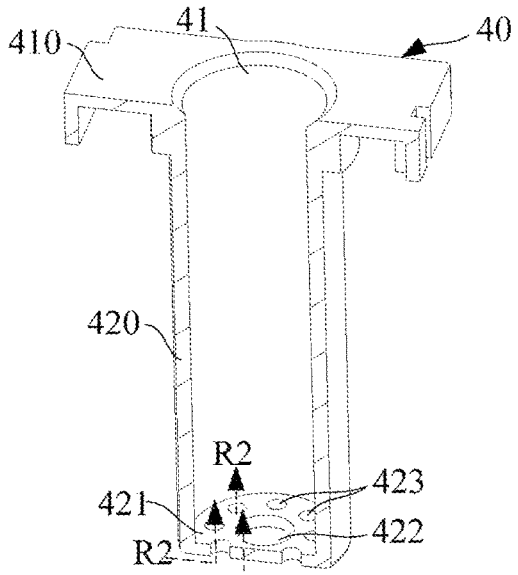
FIG. 13 is a schematic cross-sectional view of the extractor in FIG. 10 from one perspective.

Further, refer to FIG. 13, the extractor 40 further includes:

a first hole 422, located on the supporting wall 421, where an inner diameter is basically adapted to the heater 50 and is slightly greater, to allow the heater 50 to pass through the first hole 422 and then to be inserted into the receiving portion 420; and when adapted to a pin-shaped or needle-shaped heater 50, for example, as shown in FIG. 13, the first hole 422 is in a shape of a circle, and has an inner diameter approximately ranging from 3 mm to 6 mm; and a second hole 423, located on the supporting wall 421 and configured to allow external air to enter the aerosol-generating product A through the second hole 423 in an inhaling process, as shown by the arrow R2 in FIG. 13. In an implementation, the second hole 423 has an inner diameter approximately ranging from 1 mm to 2 mm. In addition, a quantity of second holes 423 may be more than one, and the second holes 423 are provided around the first hole 422.

Further, refer to FIG. 9 and FIG. 10, a structure of the bracket 30 includes:

a left side wall 310 and a right side wall 320 that are opposite to each other in a width direction, where during assembly, the left side wall 310 is a side wall adjacent to the first space 1100, and is connected to the main housing 10 in a detachable manner such as a buckle; the right side wall 320 is at least partially exposed outside the aerosol-generation device 100 after assembly, and at least partially defines an outer surface of the aerosol-generation device 100 in the width direction;

a lower end wall 350 is adjacent to the second space 1200 in a length direction, a third hole 33 is formed on the lower end wall 350, and during assembly, the heater 50 penetrates the third hole 33 from below into the bracket 30 in the length direction; and a front side wall 330 and a rear side wall 340 are opposite to each other in a thickness direction, and a window 32 is arranged at a position close to the lower end wall 350 of the front side wall 330 and the rear side wall 340. In an optional implementation, the front side wall 330 and the rear side wall 340 are not connected to or in contact with the lower end wall 350. In an implementation, the window 32 is defined by a distance between the front side wall 330 and/or the rear side wall 340 and the lower end wall 350.

In an implementation, the window 32 is directly in communication with the external air, and then the second hole 423 of the extractor 40 may be in communication with the external air through the window 32; and in an inhaling process, the external air directly enters the second hole 423 through the window 32, and then enters the receiving cavity 430 along with the aerosol generated by the aerosol-generating product A and is jointly inhaled by the user, as shown by the arrow R2 in FIG. 10.

Figure 14:
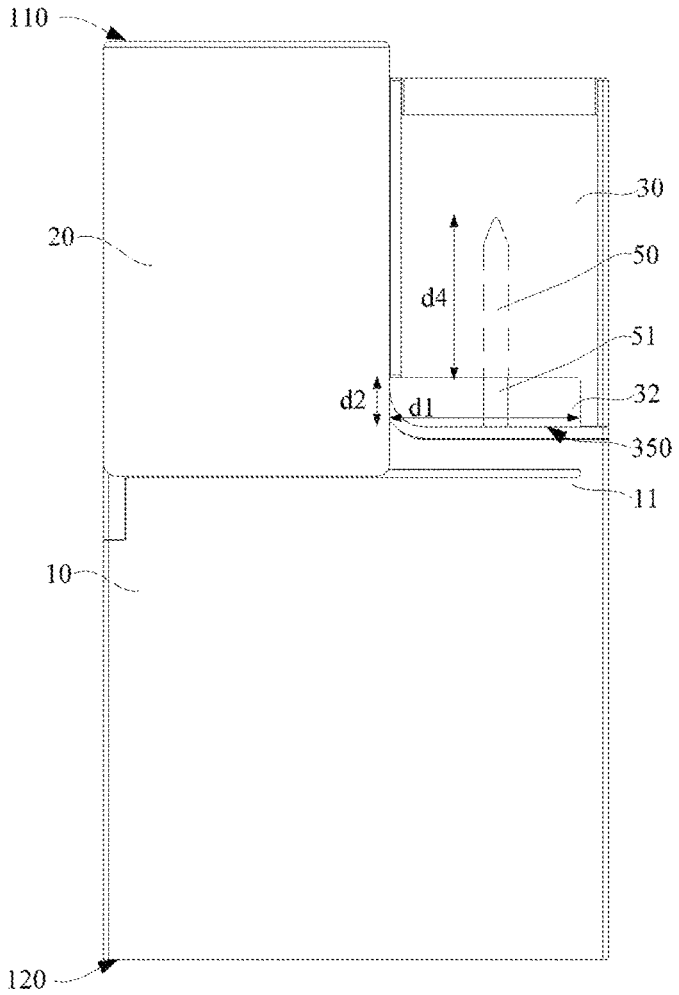
FIG. 14 is a schematic diagram of a perspective after an extractor in FIG. 6 extracts an aerosol-generating product.

Further, as shown in FIG. 9, FIG. 10, and FIG. 14, a free front end of the heater 50 penetrates into the bracket 30; and an end of the heater 50 facing away from the free front end is fixed in the main housing 10. Further, according to the implementation shown in the figure, the end of the heater 50 facing away from the free front end is surrounded and fixed by a fixing base 52.

In addition, the heater 50 has an exposed portion 51 exposed through the window 32; and certainly, the exposed portion 51 has a length approximately ranging from 2 mm to 5 mm. The exposed portion 51 of the heater 50 is visible through the window 32. Certainly, after assembly, the exposed portion 51 is defined by a size or a position of the window 32. Specifically, in this implementation, the fixing base 52 is covered by the lower end wall 350 of the bracket 30, and the exposed portion 51 of the heater 50 is completely defined by the bracket 30; and specifically, the fixing base 52 is defined by a part of the heater 50 located between the front side wall 330 and/or the lower end wall 350 of the rear side wall 340 in the length direction.

Certainly, the exposed portion 51 is close to an end of the fixing base 52 and/or the heater 50. It may be learnt from FIG. 14 that a distance d4 between the exposed portion 51 of the heater 50 and the free front end is approximately 12 mm. The exposed portion 51 is away from the free front end, and it is difficult for a cleaning tool to directly clean the exposed portion 51 from the receiving hole 41 of the extractor 40. Generally, in an implementation, a distance d4 between the exposed portion 51 of the heater 50 and the free front end is greater than 8 mm.

In still another implementation, the window 32 has a proper area, and by inserting some cleaning tools into the window 32, the exposed portion 51 of the heater 50 is cleaned during use. In some implementations, the cleaning tools are, for example, a small brush, a steel wire strip, a scraper, and the like.

In some preferred implementations, the window 32 needs to be of a proper area, to provide a necessary size for the cleaning tools to insert into, but also needs to prevent fingers of the user from being burned by the heater 50.

In a preferred implementation, an area of the window 32 is greater than 10 $mm^2$ and an area of the window 32 is less than 100 $mm^2$. In a more preferred implementation, an area of the window 32 is greater than 30 $mm^2$ and an area of the window 32 is less than 80 $mm^2$.

In the preferred implementation shown in FIG. 9 and FIG. 14, the window 32 is basically in a shape of a square. For example, the window 32 is in a shape of a strip in a width direction of the bracket 30. In a more preferred implementation, a length size d1 of the window 32 extending in the width direction of the bracket 30 approximately ranges from 10 mm to 20 mm; and a width size d2 of the window 32 extending in a length direction of the bracket 30 approximately ranges from 3 mm to 6 mm.

In a specific implementation shown in FIG. 14, the length size d1 of the window 32 is 17 mm; and the width size d2 of the window 32 is approximately 4.2 mm.

In addition, in still another optional implementation, at least one of the length size d1 and the width size d2 of the window 32 shall not be greater than 10 mm, which is conducive to preventing the fingers of the user from inserting. In a more preferred implementation, at least one of the length size d1 and the width size d2 of the window 32 shall not be greater than 6 mm.

Correspondingly, a length of the exposed portion 51 of the heater 50 basically ranges from 3 mm to 6 mm. In a preferred implementation, a length of the heater 50 penetrating into the receiving portion 420 of the extractor 40 approximately ranges from 10 mm to 18 mm. In a preferred implementation, a length of the exposed portion 51 of the heater 50 does not exceed ⅓ of a total length of the heater 50.

Further, refer to FIG. 9 and FIG. 10, to facilitate guide of the extractor 40 and the bracket 30 during assembly, movement, or removal; and the bracket 30 further has a first inner wall 360 and a second inner wall 370. As shown in the figure, the first inner wall 360 and the second inner wall 370 are configured in a shape of an arc, and the first inner wall 360 and the second inner wall 370 are opposite to each other. In addition, the first inner wall 360 and the second inner wall 370 are in a shape of an arc that is curved outward in the width direction, and a guide accommodating space 31 is defined between the first inner wall 360 and the second inner wall 370. A shape of the accommodating space 31 is basically the same as a shape of the receiving portion 420 of the extractor 40, and a size volume of the accommodating space 31 is slightly greater than a volume of the receiving portion 420. The first inner wall 360 and the second inner wall 370 provide guidance when the extractor 40 is stably assembled to the bracket 30 and during movement or removal.

Alternatively, in another variation implementation, when the aerosol-generation device 100 does not have components of the extractor 40, the accommodating space 31 between the first inner wall 360 and the second inner wall 370 is configured as a receiving cavity 430 configured to receive the aerosol-generating product A.

In addition, as shown in FIG. 5 and FIG. 6, the door cover 20 blocks or closes the window 32 at the closed position; and at the open position, the door cover 20 opens or reveals the window 32*a*.

In the preferred implementation shown in FIG. 9 and FIG. 10, there is a distance between the first inner wall 360 and the left side wall 310 of the bracket 30, thereby forming a first heat insulation cavity 34 between the first inner wall 360 and the left side wall 310 of the bracket 30; and there is a distance between the second inner wall 70 and the right side wall 320 of the bracket 30, thereby forming a second heat insulation cavity 35 between the second inner wall 70 and the right side wall 320 of the bracket 30.

In the implementation shown in the figure, the first heat insulation cavity 34 and/or the second heat insulation cavity 35 are empty and open, and are in communication with the external air, thereby forming heat insulation through low heat conduction of the air; the first heat insulation cavity 34 prevents heat of the heater 50 from being transferred outward in a radial direction to an electric core 111 in the first space 1100; and/or the second heat insulation cavity 35 prevents the heat of the heater 50 from being transferred outward in a radial direction to the right side wall 320.

In some variation implementations, the first heat insulation cavity 34 and/or the second heat insulation cavity 35 are closed cavities, and internal pressures of the first heat insulation cavity 34 and the second heat insulation cavity 35 may be configured to be lower than the external pressure. In other words, the first heat insulation cavity 34 and/or the second heat insulation cavity 35 have a vacuum degree; and this is conducive to preventing heat transfer.

Alternatively, in some other variation implementations, the first heat insulation cavity 34 and/or the second heat insulation cavity 35 are filled with some heat insulation materials, such as aerogel, porous polymer, porous polyurethane, foam cotton, and the like; and this is conducive to preventing heat transfer.

Further, refer to FIG. 9 and FIG. 10, the receiving portion 420 of the extractor 40 is also at least partially exposed to the window 32.

Further, in the preferred implementation shown in FIG. 10, a circuit board 12 that controls operation of the aerosol-generation device 100 is mounted in the second space 1200 of the aerosol-generation device 100; and a charging interface 13 located at a far end 120 is electrically connected to the circuit board 12 during use, and then charges an electric core 111 after an external power supply device is connected.

For the foregoing aerosol-generation device 100, cleaning of the debris or aerosol condensate dropped from the aerosol-generating product A may include:

when the extractor 40 is not removed, cleaning an inner wall of the receiving portion 420 and a part of a surface of the heater 50 by extending tools such as a brush through a receiving hole 41;

after removing the extractor 40, continuing to perform cleaning by extending tools such as a brush into the inner wall of the accommodating space 31; and cleaning the exposed portion 51 of the heater 50 by extending the tools through the window 32.

Further, the bracket 30 is removed from the main housing 10, as shown in FIG. 9, so that the heater 50 is basically completely exposed, and the surface of the heater 50 may be deeply and completely cleaned through a cleaning tool.

Further, FIG. 15 to FIG. 18 show a schematic diagram of a structure of still another embodiment of an aerosol-generation device 100; and in this implementation, the aerosol-generation device 100 includes:

a main housing 10*a;* a door cover 20*a*, positioned at a near end 110*a* of the main housing 10*a*, and movable between an open position and a closed position relative to the main housing 10*a*; and for example, moving or rotating in a width direction of the main housing 10*a*.

Figure 18:
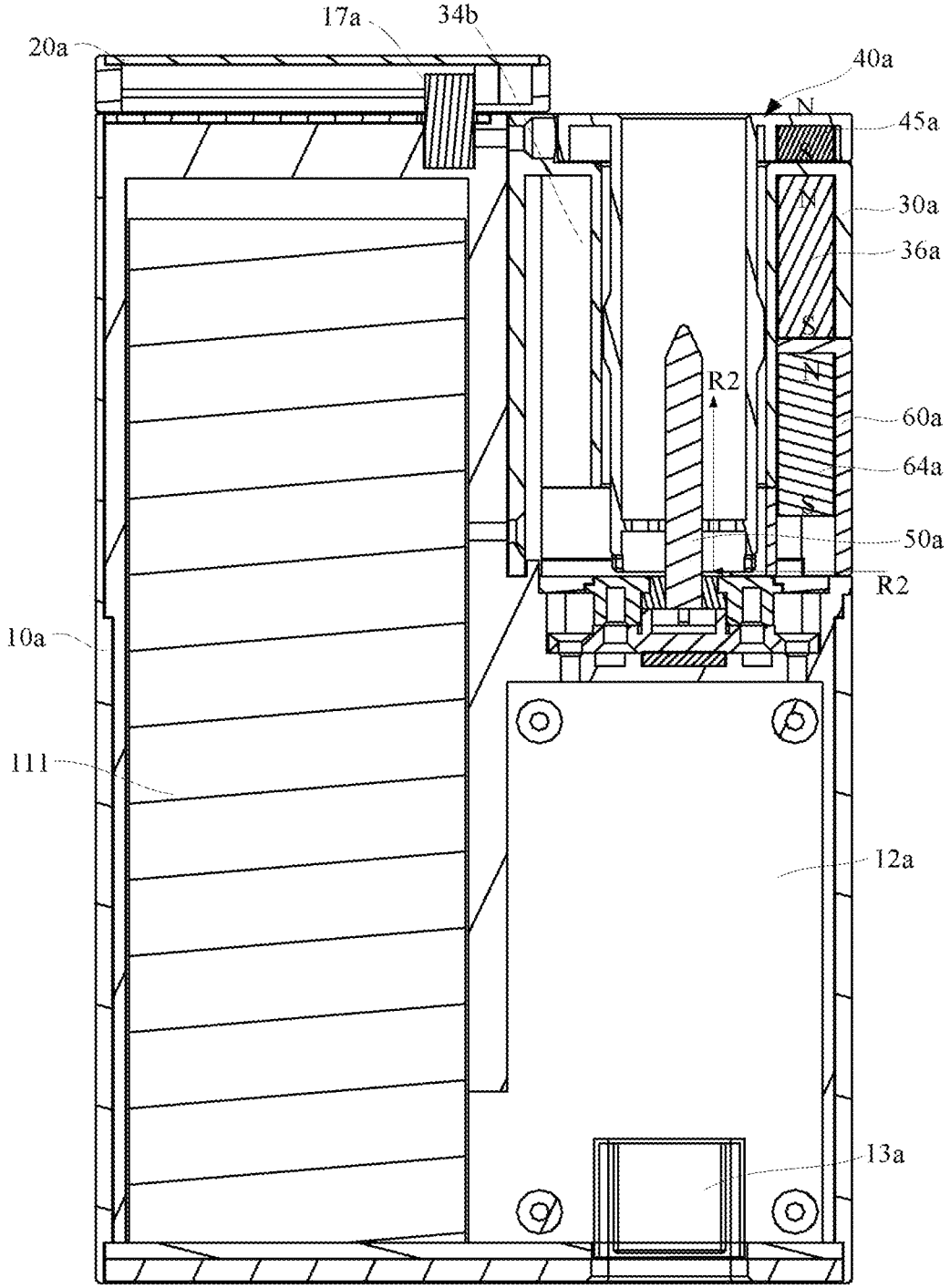
FIG. 18 is a schematic cross-sectional view of the aerosol-generation device in FIG. 16 from one perspective.

In addition, refer to FIG. 18, the aerosol-generation device 100 further includes a limiting protrusion 17*a* located between the main housing 10*a* and the door cover 20*a*; and during assembly, the limiting protrusion 17*a* is located at the near end 110*a* of the main housing 10*a*, and at least partially protrudes relative to the main housing 10*a*. When the door cover 20*a* moves relative to the main housing 10*a* in a width direction, the limiting protrusion 17*a* is configured to provide a limit at the open position and the closed position of the door cover 20*a*. Certainly, in a more preferred implementation, the door cover 20*a* covers or hides the limiting protrusion 17*a* at any moving position. The limiting protrusion 17*a* is not exposed to a surface of the aerosol-generation device 100 at any moving position of the door cover 20*a*.

In addition, the aerosol-generation device 100 further includes:

a bracket 30*a*, at least partially defines a window 32*a* with the main housing 10*a*; a heater 50*a*, at least partially exposed in the window 32*a*; and an extractor 40*a*, supported and kept by the bracket 30*a*. During use, the extractor 40*a* is configured to extract the aerosol-generating product A received in the aerosol-generation device 100*a*.

Figure 16:
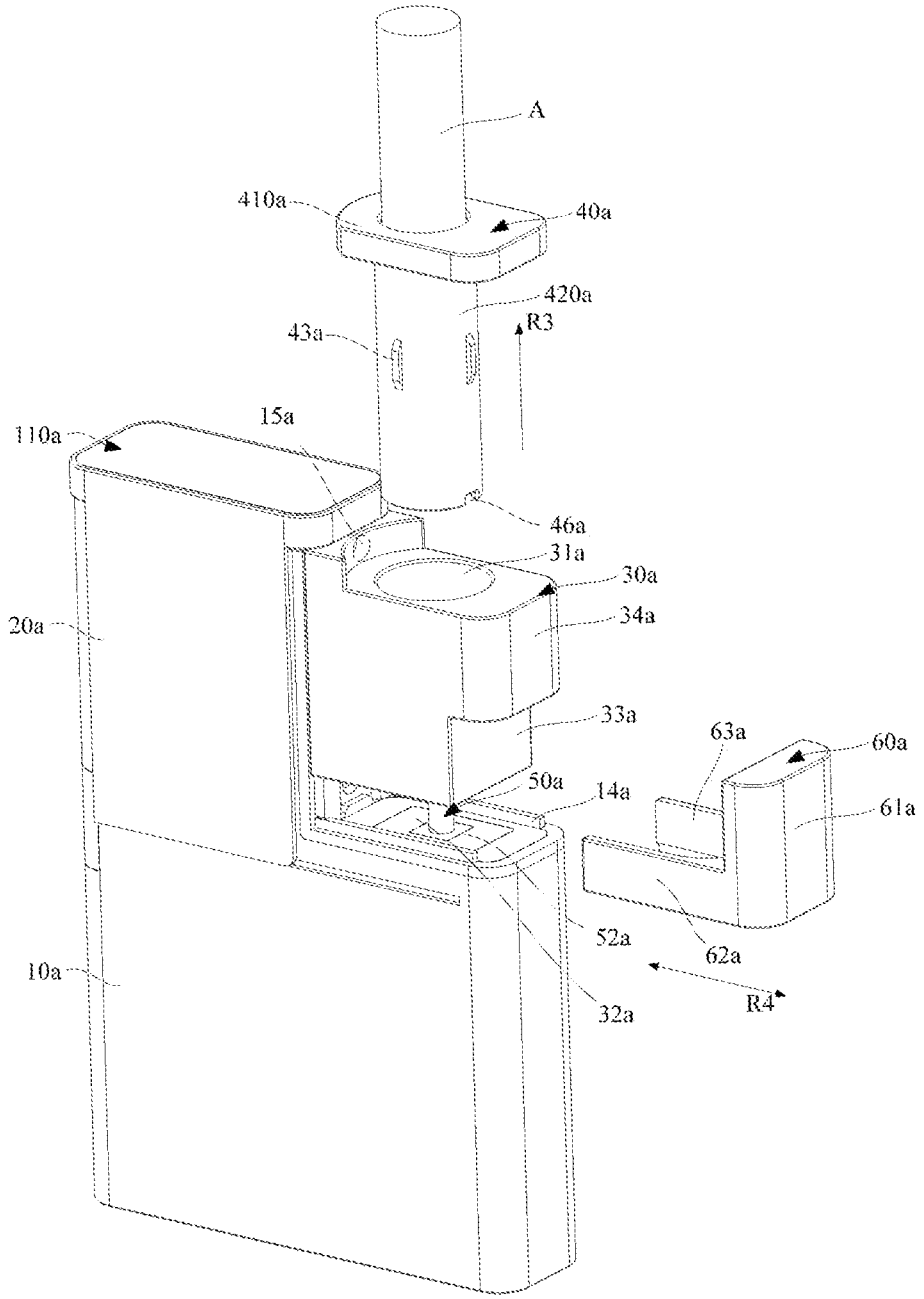
FIG. 16 is an exploded schematic diagram of each part of the aerosol-generation device in FIG. 15 from one perspective.

Further, as shown in FIG. 16, to facilitate the extractor 40*a* to maintain a stable connection with the bracket 30*a* at the operating position, a latching protrusion 43*a* is arranged on the extractor 40*a*; and the latching protrusion 43*a* is configured to form a connection by engaging the extractor 40*a* with the bracket 30*a* at the operating position. In the preferred implementation shown in FIG. 16, a quantity of latching protrusions 43*a* is more than one, and the latching protrusions 43*a* are configured in the form of ridges located on an outer surface of the receiving portion 420*a* of the extractor 40*a*.

In this embodiment, the extractor 40*a* further extracts the aerosol-generating product A through an operation of directly removing from the bracket 30*a* in the length direction, as shown by the arrow R3 in FIG. 16.

Further, refer to FIG. 16, a first connecting hole 15*a* and/or a second connecting hole 16*a* are provided on the bracket 30*a*. Certainly, the first connecting hole 15*a* is provided adjacent to the first space 1100. During use, connecting components such as a screw/bolt/screw are mounted in the first connection hole 15*a* and/or the second connection hole 16*a* to connect the bracket 30*a* and the main housing 10*a*. Specifically, the first connecting hole 15*a* is provided adjacent to the near end 110*a*; and the second connecting hole 16*a* is provided adjacent to the second space 1200.

Further, according to the preferred implementation shown in the figure, when the extractor 40*a* is kept on the bracket 30*a*, the first connecting hole 15*a* is covered or hidden by the extractor 40*a*. Specifically, the first connecting hole 15*a* is covered by the operating portion 41*a* of the extractor 40*a*. In addition, after removing the extractor 40*a*, the first connecting hole 15*a* is exposed. In this case, the user may disassemble connecting components such as the screw/bolt/screw located in the first connecting hole 15*a* by using tools such as a screwdriver; and further, a connection between the bracket 30*a* and the main housing 10*a* is released, so that the bracket 30*a* may be disassembled from the main housing 10*a*.

In addition, the second connecting hole 16*a* is exposed through the window 32*a*; or the second connecting hole 16*a* is visible through the window 32*a*; and the user may insert the screwdriver into the second connecting hole 16*a* through the window 32*a* to disassemble connecting components such as the screw/bolt/screw.

Figure 15:
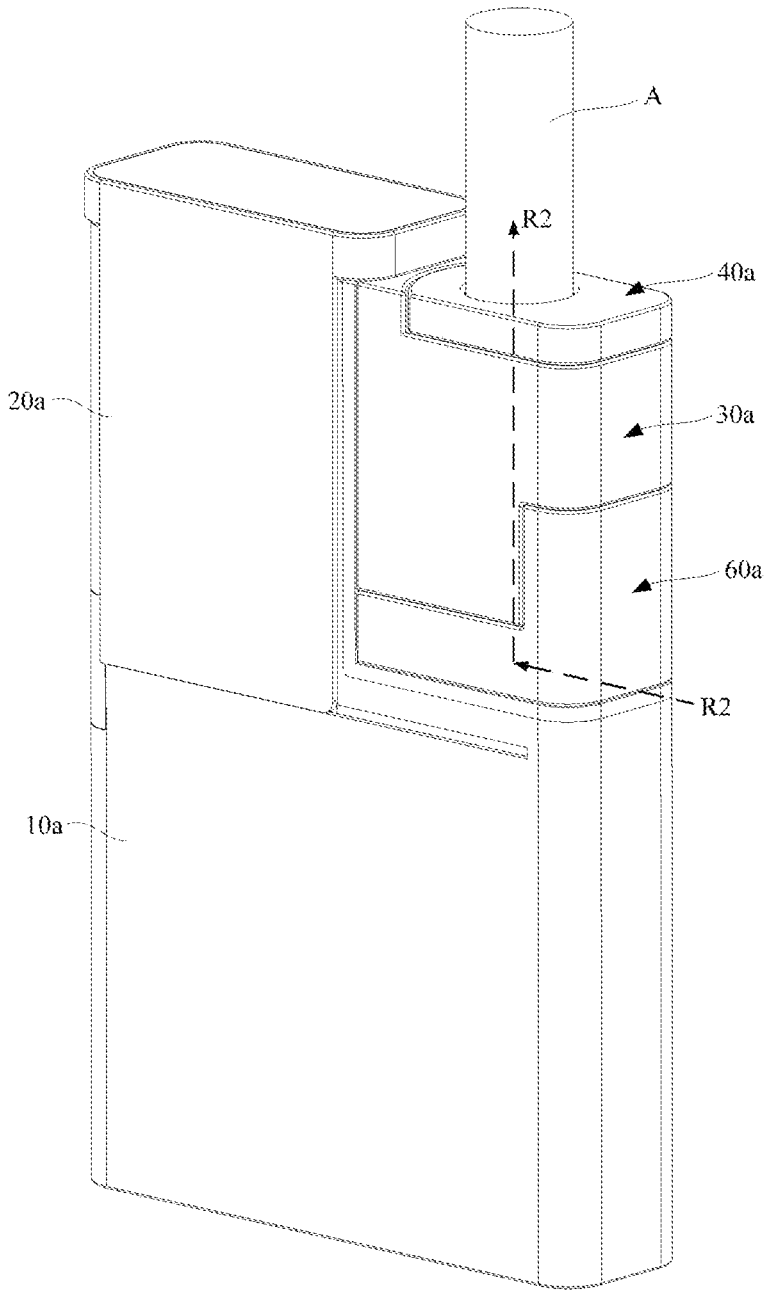
FIG. 15 is a schematic diagram of a use state of still another embodiment of the aerosol-generation device in FIG. 1.
Figure 17:
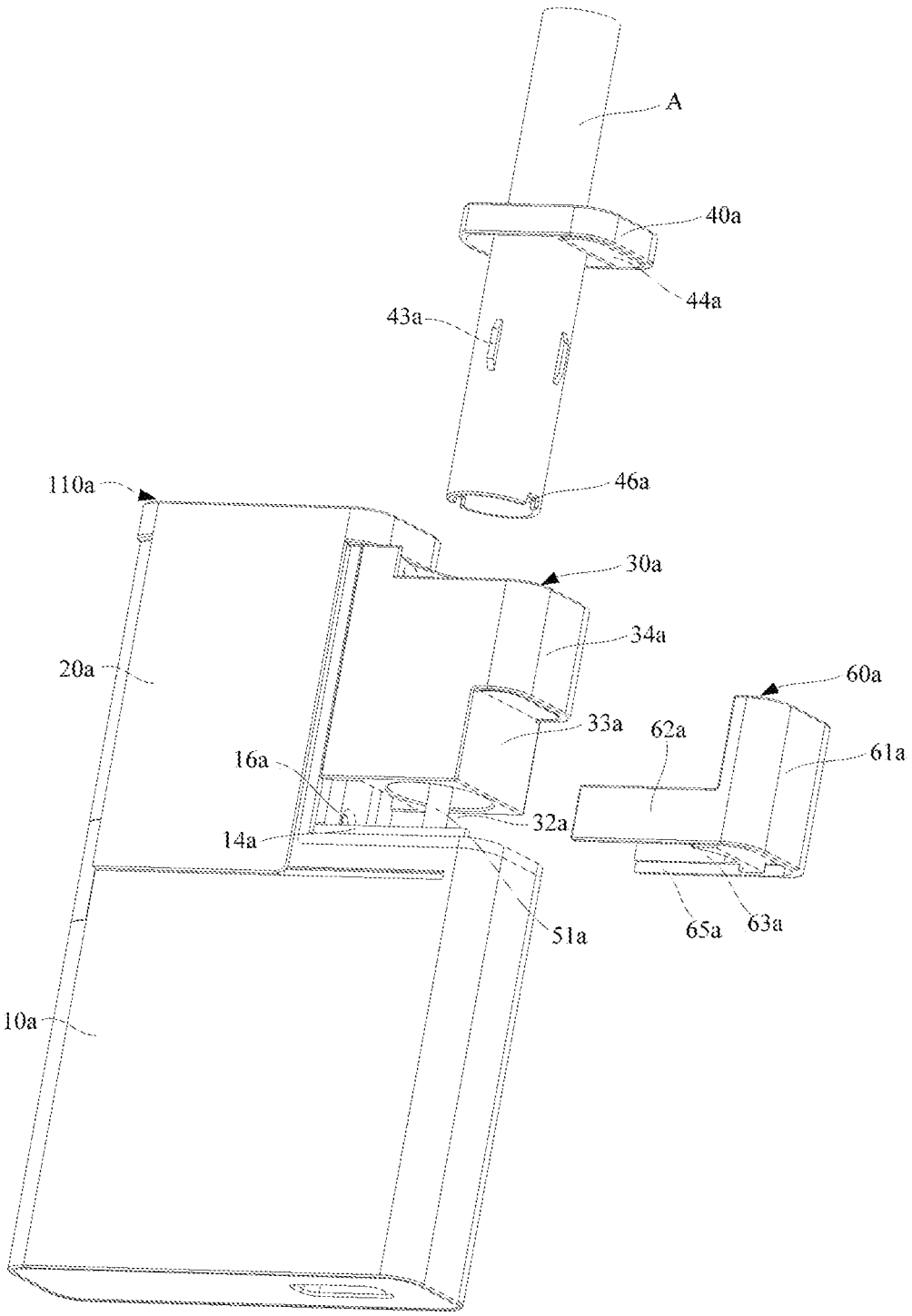
FIG. 17 is an exploded schematic diagram of each part of the aerosol-generation device in FIG. 15 from still another perspective.

Further, refer to FIG. 15 to FIG. 17, the exemplary aerosol-generation device 100 further includes:

a blocking member 60*a*, configured to block or cover or close the window 32*a*. Further, when there is no need to open the window 32*a* for the sake of inhaling, safety protection, and the like, the window 32*a* is blocked or covered or closed by the blocking member 60*a*. When the exposed portion of the heater 50*a* exposed through the window 32*a* needs to be cleaned, or when connecting components such as the screw/bolt/screw in the second connecting hole 16*a* need to be disassembled, the window 32*a* may be opened by moving or removing the blocking member 60*a*.

Further, according to the preferred embodiment shown in FIG. 15 to FIG. 17, the blocking member 60*a* is removably combined with the bracket 30*a* to block or cover or close the window 32*a*. When the blocking member 60*a* is combined with the bracket 30*a*, the window 32*a* is blocked or covered or closed. When the blocking member 60*a* is removed from the bracket 30*a*, the window 32*a* is opened.

Further, as shown in FIG. 15 to FIG. 17, when the blocking member 60*a* is combined with the bracket 30*a*, a surface of the blocking member 60*a* is flatly joined to a surface of the bracket 30*a*.

In the preferred implementation shown in the figure, the blocking member 60*a* is combined with the bracket 30*a* in a width direction of the main housing 10*a*, or is removed from the bracket 30*a* in a width direction of the main housing 10*a*.

In a more preferred implementation, a guide rail 14*a* extending in the width direction is further arranged on the main housing 10*a*; and Correspondingly, a guide groove 65*a* is provided on the blocking member 60*a*, to provide guidance during the operation of combining the blocking member 60*a* with the bracket 30*a* or removing the blocking member 60*a*.

In this embodiment, the window 32*a* is open on a front side and a rear side in a thickness direction of the main housing 10*a* and on a right side facing away from the first space 1100 in the width direction.

Figure 20:
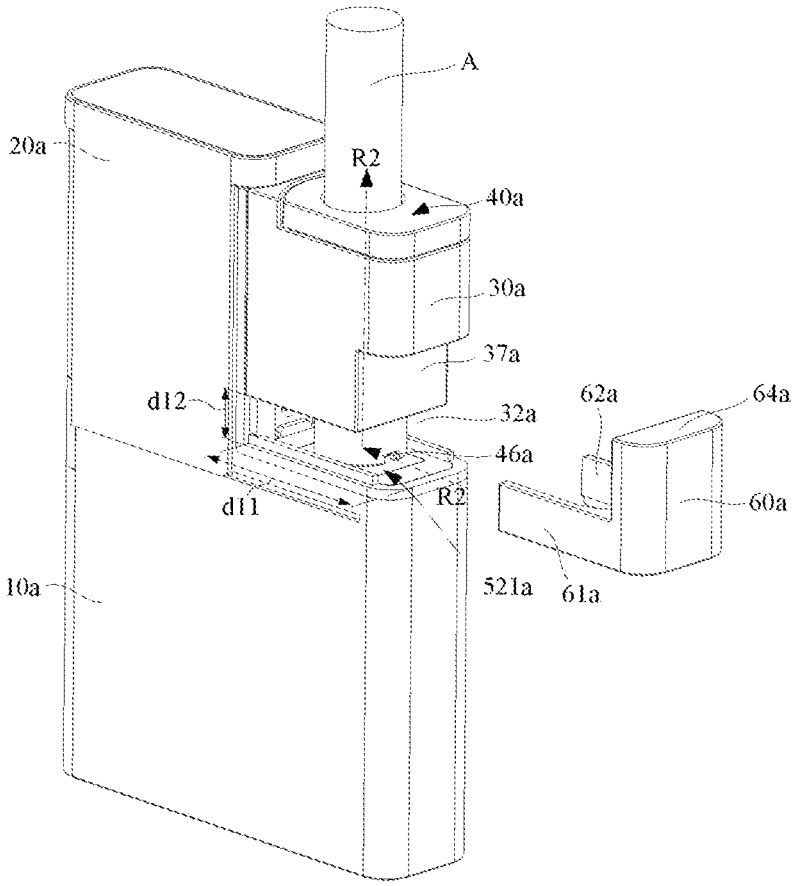
FIG. 20 is a schematic diagram after a blocking member in FIG. 15 is removed.
Figure 21:
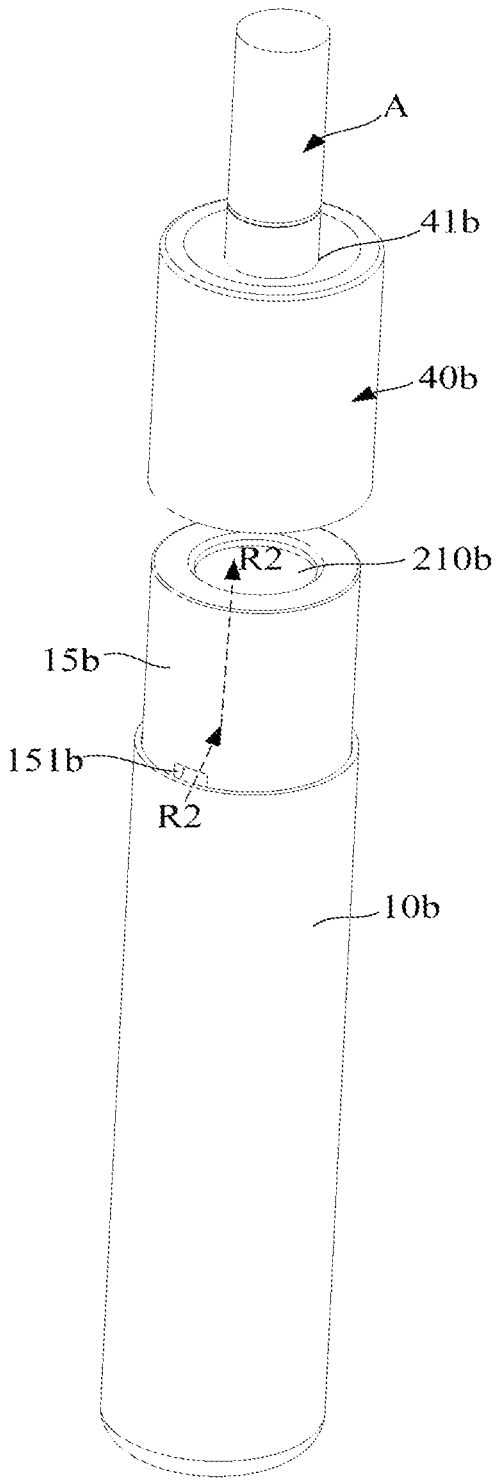
FIG. 21 is a schematic diagram of an aerosol-generation device in an extraction state according to still another embodiment.

Further, as shown in FIG. 20, in an open size of the window 32*a* on two sides in the thickness direction, a length size d11 is 20 mm; and a width size d12 is approximately 6 mm.

In this embodiment, the window 32*a* is at least partially defined by the bracket 30*a*. Specifically, the window 32*a* is defined by a distance space between the bracket 30*a* in the length direction and the main housing 10*a*.

Further, refer to FIG. 16 and FIG. 17, the bracket 30*a* further defines an accommodating space 31*a* that is at least partially configured to accommodate the extractor 40*a*. The accommodating space 31*a* extends in the length direction, and a shape of the accommodating space 31*a* is basically the same as a shape of the receiving portion 420*a* of the extractor 40*a*. A size volume of the accommodating space 31*a* is slightly greater than a volume of the receiving portion 420*a*. An inner wall of the accommodating space 31*a* is configured to provide guidance when the extractor 40*a* is stably assembled onto the bracket 30*a*, and during movement or removal.

Similarly, a receiving cavity configured to receive the aerosol-generating product A is defined by the receiving portion 420*a* of the extractor 40*a* in the foregoing implementation. When there are not components of the extractor 40*a*, the accommodating space 31*a* may be mainly used as a receiving cavity configured to receive the aerosol-generating product A.

Further, refer to FIG. 16 and FIG. 17, the bracket 30*a* has a protruding portion 34*a* protruding away from the first space 1100 in the width direction, and a recessed portion 33*a* is defined between the protruding portion 34*a* and other parts of the bracket 30*a*. Certainly, as shown in the figure, the protruding portion 34*a* is located at a near end 110*a*, so that the recessed portion 33*a* is formed adjacent to the window 32*a*.

As shown in the figure, the accommodating space 31*a* avoids the protruding portion 34*a*.

Correspondingly, the blocking member 60*a* includes a main body portion 61*a* extending in the length direction, and a first blocking arm 62*a* and a second blocking arm 63*a* that basically extend in the width direction from two sides in the thickness of the main body portion 61*a*. After assembly, the first blocking arm 62*a* and the second blocking arm 63*a* separately cover, block, or seal the window 32*a* from two opposite sides in the thickness direction. The main body portion 61*a* covers, blocks, or seals the window 32*a* from the right side in the width direction. In addition, after assembly, the main body portion 61*a* is accommodated and kept in the recessed portion 33*a*; and a surface of the blocking member 60*a* is flatly joined to the bracket 30*a*.

As shown in the figure, the guide groove 65*a* is formed on the first blocking arm 62*a* and/or the second blocking arm 63*a*.

Further, refer to FIG. 18, a first magnetic member 36*a* is further arranged on the bracket 30*a*; and certainly, in a preferred implementation, the first magnetic member 36*a* is arranged in the protruding portion 34*a*.

Correspondingly, a second magnetic member 64*a* is further arranged on the blocking member 60*a*, and is configured to magnetically attract the first magnetic member 36*a* when combined with the bracket 30*a* to block the window 32*a*, thereby causing the blocking member 60*a* to be stably kept on the bracket 60*a*. In a preferred implementation, the second magnetic member 64*a* is accommodated on the main body portion 61*a* of the blocking member 60*a*.

Correspondingly, a third magnetic member 45*a* is arranged on the extractor 40*a*, and is configured to magnetically attract the first magnetic member 36*a* at an operating position, thereby causing the extractor 40*a* to be stably kept on the bracket 60*a*.

Further, in the preferred implementation shown in the figure, after assembly, in the length direction, magnetic pole arrangement directions of the first magnetic member 36*a*, the second magnetic member 64*a*, and the second magnetic member 45*a* are the same. For example, in the preferred embodiment shown in the figure, the first magnetic member 36*a* has a first magnetic pole, such as an N pole, toward a near end 110*a*, and a second magnetic pole, such as an S pole, toward a far end 120*a*. In addition, the second magnetic member 64*a* also has a first magnetic pole, such as an N pole, toward the near end 110*a*, and a second magnetic pole, such as an S pole, toward the far end 120*a*. Correspondingly, the third magnetic member 45*a* also has a first magnetic pole, such as an N pole, toward the near end 110*a*, and a second magnetic pole, such as an S pole, toward the far end 120*a*.

After assembly, the first magnetic member 36*a* may be simultaneously magnetically attracted to the second magnetic member 64*a* and the second magnetic member 45*a* that are located on an upper side and a lower side.

Figure 19:
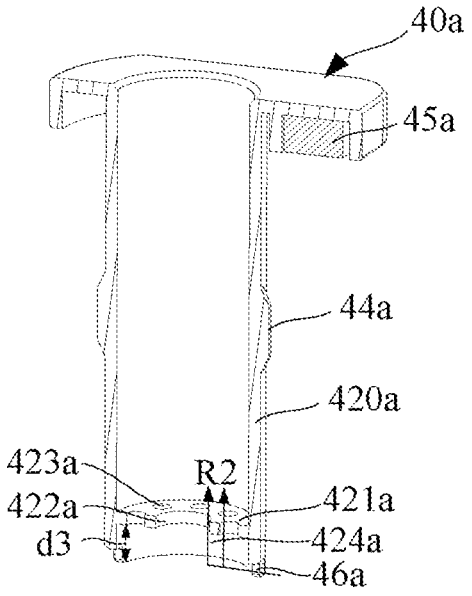
FIG. 19 is a schematic cross-sectional view of the extractor in FIG. 18 from still another perspective.

Further, refer to FIG. 19 and FIG. 20, the receiving portion 420*a* of the extractor 40*a* has a relatively greater length. Further, after assembly, the receiving portion 420*a* of the extractor 40*a* completely covers the heater 50*a*, and the heater 50*a* is not visible when the extractor 40*a* is combined with the bracket 30*a*. In a specific implementation, a front end of the receiving portion 420*a* abuts against an upper surface 521*a* of a fixing base 52*a* facing the near end 110*a*.

Further, a first air port 46*a* that allows air from the window 32*a* to enter the extractor 40*a* is provided at the front end of the receiving portion 420*a* of the extractor 40*a* for allowing air to enter the receiving portion 420*a*.

in this implementation, the receiving portion 420*a* has a supporting wall 421*a* inside, configured to provide support to the aerosol-generating product A. Further, as shown in FIG. 18 and FIG. 19, the extractor 40*a* further has an extending wall 424*a* extending from the receiving portion 420*a*, and the extending wall 424*a* abuts against the upper surface 521*a* of the fixing base 52*a* during assembly. During use, on one hand, the extending wall 424*a* may block the exposed portion 51*a* surrounding and blocking the heater 50*a* exposed through the window 32*a*; and on the other hand, more importantly, a specific space is formed between the fixing base 52*a* and the supporting wall 421*a* through the extending wall 424*a*, to block or keep the aerosol seeping or leaking from the first hole 422*a* and/or the second hole 423*a*, which is conducive to preventing the aerosol from seeping or leaking from the first hole 422*a* and/or the second hole 423*a* and being viewed by the user.

Certainly, the extending wall 424*a* is open to the exposed portion 51*a* of the heater 50*a* after the extractor 40*a* is moved or removed from the bracket 30*a* to extract the aerosol-generating product A, and then the user may clean the exposed portion 51*a* of the heater 50*a* through the window 32*a* by using the cleaning tool.

Correspondingly, the first air port 46*a* is formed on the extending wall 424*a*.

Further, in this embodiment, as shown in FIG. 16, the exposed portion 51*a* of the heater 50*a* is defined by the bracket 30*a* and the fixing base 52*a* that fixes the end of the heater 50*a*. Specifically, in this implementation, the exposed portion 51*a* is defined by a part of the heater 50*a* located between the bracket 30*a* and the fixing base 52*a*. Certainly, the exposed portion 51*a* is close to the end of the fixing base 52*a* and/or the heater 50*a*.

Similarly, a distance between the exposed portion 51*a* of the heater 50*a* and the free front end is approximately 12 mm. The exposed portion 51*a* is away from the free front end, and it is difficult for a cleaning tool to directly clean the exposed portion 51*a* from the receiving hole 41*a* of the extractor 40*a*.

Similarly, a first hole 422*a* for the heater 50*a* to pass through to the aerosol-generating product A is provided on the supporting wall 421*a*; and a second hole 423*a* for the air to enter the aerosol-generating product A.

In an inhaling process, for the flow of airflow, refer to the arrow R2 shown in FIG. 15 to FIG. 20. The external air enters the window 32*a* through a gap between the bracket 30*a* and/or the blocking member 60*a* and the main housing 10*a*. The air from the window 32*a* enters the first air port 46*a* in the extractor 40*a*, enters the receiving portion 420*a* of the extractor 40*a*, and is inhaled into the aerosol-generating product A through the second hole 423*a* until the air is inhaled.

As shown in the figure, in the preferred implementation, an airflow channel includes an air inlet portion extending toward the heater 50*a* in a radial direction of the heater 50*a*, and an air outlet portion extending in the length direction toward the near end 110*a* in the receiving cavity. Certainly, the air inlet portion passes through the first air port 46*a* in the extractor 40*a* that allows the air from the window 32*a* to enter, and the air outlet portion passes through the second hole 423*a*.

In the implementation shown in FIG. 19, a distance d3 between the supporting wall 421*a* and the front end of the receiving portion 420*a* approximately ranges from 3 mm to 5 mm.

Alternatively, in another variation implementation, the blocking member 60*a* opens or blocks the window 32*a* by moving or rotating at different positions on the bracket 30*a*. For example, the blocking member 60*a* is configured to move in the length direction on the bracket 30*a*, thereby blocking the window 32*a* when moving close to the second space 1200, and at least partially opening the window 32*a* when moving away from the second space 1200. Certainly, in more variation implementations, the blocking member 60*a* may be further in the width direction.

Further, according to FIG. 18, a first heat insulation cavity 34*b* is further defined in the bracket 30*a*; and in arrangement, the first heat insulation cavity 34*b* is located between a receiving cavity configured to receive the aerosol-generating product A and the first space 1100 in the width direction, which is conducive to preventing the heat of the heater 50*a* from being transferred to an electric core 111 in the first space 1100.

In the optional implementation, the first heat insulation cavity 34*b* is a closed space, and the interior of the first heat insulation cavity 34*b* may be filled with air, thereby forming heat insulation by using low heat conductivity of the air. Alternatively, in some other implementations, the first heat insulation cavity 34*b* is evacuated, so that pressure of the first heat insulation cavity 34*b* is lower than the external pressure, to form heat insulation. Alternatively, in some other implementations, the first heat insulation cavity 34*b* is filled with a porous body, foam, aerogel, and the like, to improve heat insulation.

For the foregoing aerosol-generation device 100, cleaning of the debris or aerosol condensate dropped from the aerosol-generating product A may include:

- when the extractor 40*a* is not removed, performing cleaning by extending tools such as a brush into an inner wall of the receiving portion 420*a* and a part of a surface of the heater 50*a* through a receiving hole 41*a;*
- after removing the extractor 40*a*, continuing to clean the inner wall of the accommodating space 31*a* by extending tools such as a brush;
- after continuing to remove the blocking member 60*a*, exposing the exposed portion 51*a* of the heater 50*a* through the window 32*a*, and then cleaning the exposed portion 51*a* of the heater 50 through the cleaning tool being inserted into the window 32*a*; and
- after removing screws in the first connecting hole 15*a* and the second connecting hole 16*a* with a screwdriver, removing the bracket 30*a*, so that the heater 50*a* is basically completely exposed, and then a surface of the heater 50*a* may be deeply and completely cleaned with a cleaning tool.

Further, FIG. 21 to FIG. 24 show a schematic diagram of an aerosol-generation device 100*b* according to still another embodiment. In this implementation, the aerosol-generation device 100*b* is configured in a generally slender shape of a cylinder, has a length size approximately ranging from 90 mm to 110 mm, and an outer diameter size approximately ranging from 15 mm to 20 mm.

Further, the aerosol-generation device 100*b* further includes a near end 110*b* and a far end 120*b* that are opposite to each other in a length direction; and

- a first housing 10*b*, close to the far end 120*b*, where
- a second housing 15*b* adjacent to the near end 110*b* is further arranged on the first housing 10*b*; and
- an extractor 40*b*, located on the near end 110*b*, and configured to extract the aerosol-generating product A, where in the preferred implementation, the extractor 40*b* extracts the aerosol-generating product A by being directly removed from the second housing 10*b*.

Figure 22:
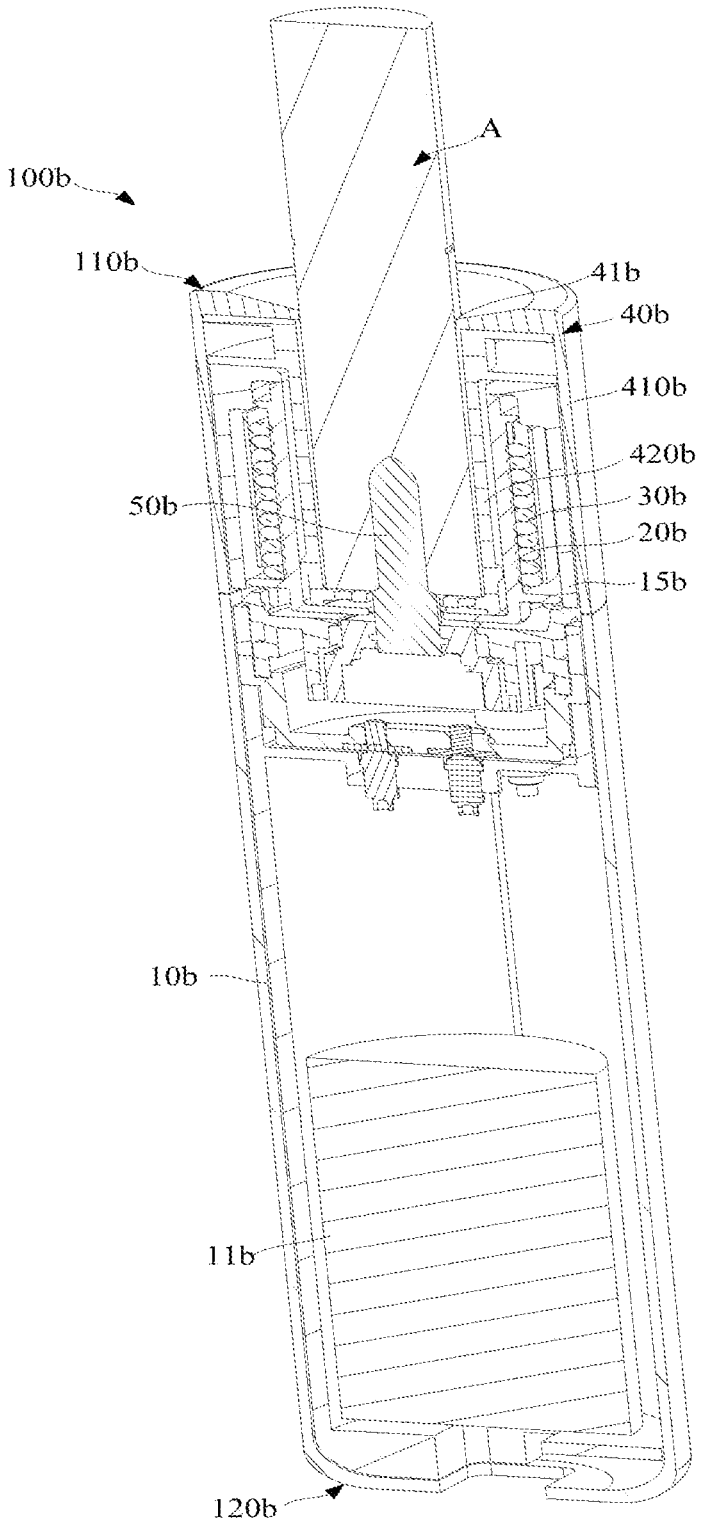
FIG. 22 is a schematic cross-sectional view of the aerosol-generation device in FIG. 21 in an operating state.
Figure 23:
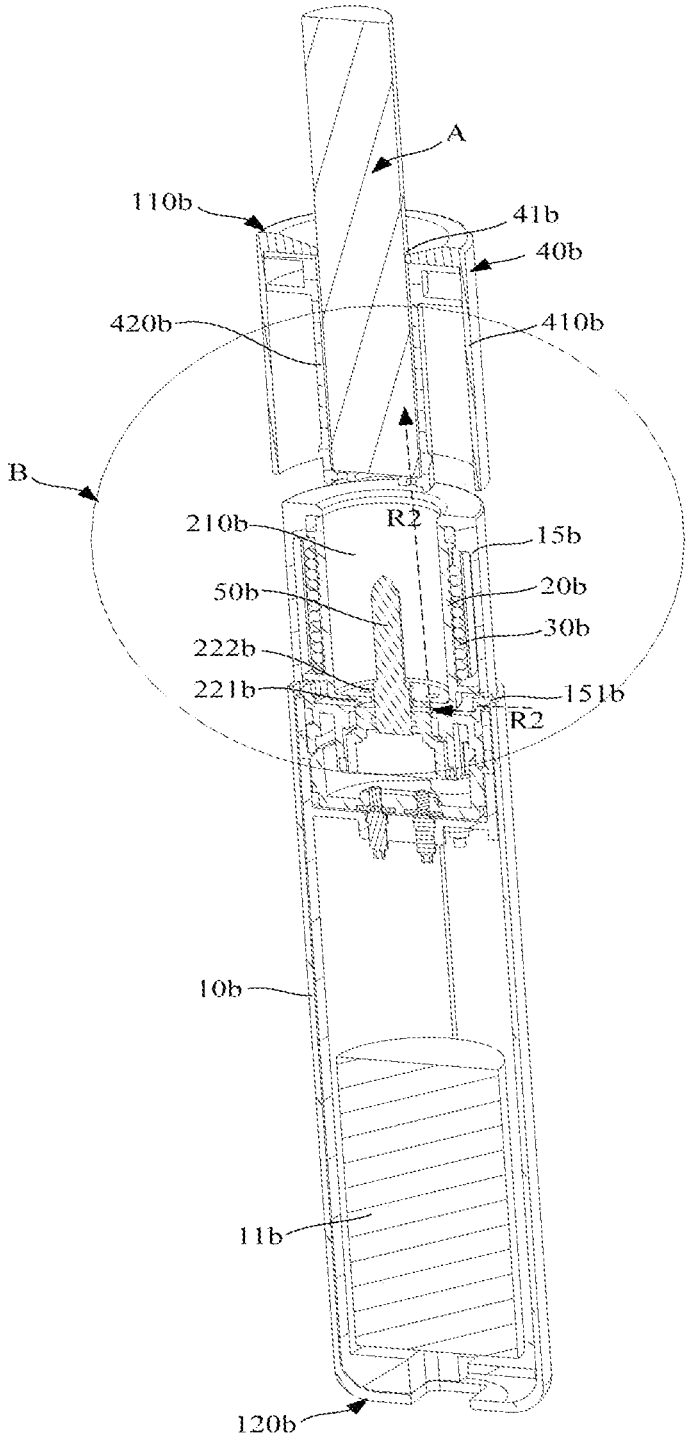
FIG. 23 is a schematic cross-sectional view of the aerosol-generation device in FIG. 21 in an extraction state.

Further, as shown in FIG. 22 and FIG. 23, the second housing 15*b* adjacent to the near end 110*b* is further arranged on the first housing 10*b*; and correspondingly, the extractor 40*b* includes an annular operating portion 410*b* and a receiving portion 420*b* in a shape of a cylinder located in the operating portion 410*b*. In an implementation, the user may exert a force on the operating portion 410*b* with a finger to perform an extraction operation; and the aerosol-generating product A is removably received in the receiving portion 420*b* through the receiving hole 41*b* defined by the operating portion 410*b*. During assembly, the operating portion 410*b* is arranged around the second housing 15*b*; in an operating state, the operating portion 410*b* abuts against an end portion of the second housing 15*b* toward the near end 110*b*, and is stably kept on the second housing 15*b*; and an outer surface of the second housing 15*b* is further configured to provide guidance when performing the extraction operation on the extractor 40*b* by the user.

Figure 24:
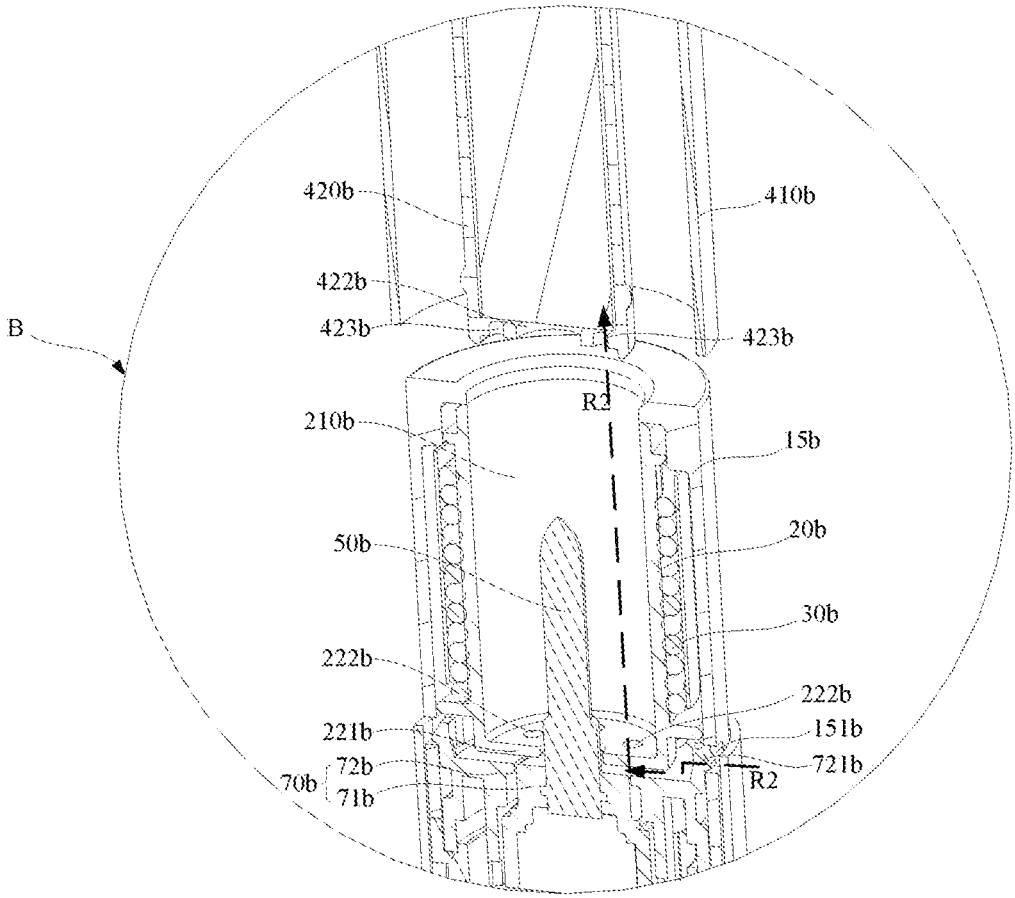
FIG. 24 is an enlarged view of a part B in FIG. 23.

Further, as shown in FIG. 24, the receiving portion 420*b* has a supporting wall 421*b* configured to support the aerosol-generating product A; a first hole 422*b* is provided on the supporting wall 421*b* for a susceptor 50*b* to pass through into the receiving portion 420*b*, thereby facilitating the susceptor 50*b* to be inserted into the aerosol-generating product A; and a second hole 423*b* is further provided on the supporting wall 421*b*, and is configured to allow air to enter the aerosol-generating product A of the receiving portion 420*b*.

Further, the second housing 15*b* is provided with:

a bracket 20*b*, basically in a shape of a tube extending in a length direction of the second housing 15*b*, where the bracket 20*b* is basically coaxially arranged with the second housing 15*b*, and is located in the second housing 15*b*; and an accommodating space 210*b* is defined and formed in the bracket 20*b*, and during use, the receiving portion 420*b* of the extractor 40*b* is received in the accommodating space 210*b* to form an operating state of the heatable aerosol-generating product A;

a magnetic field generator, such as an induction coil 30*b* surrounding the bracket 20*b*, configured to generate a changing magnetic field; and a susceptor 50*b*, configured to generate heat when the changing magnetic field penetrates the susceptor 50*b* to heat the aerosol-generating product A, where the susceptor 50*b* is preferably configured in a shape of a pin, a needle, or a sheet that extends in an axial direction at least partially from the accommodating space 210*b*, which is conducive to being inserted into the aerosol-generating product A when the extractor 40*b* is received in the accommodating space 210*b*.

Further, according to FIG. 24, a free front end of the susceptor 50*b* is located in the accommodating space 210*b*, and is kept by the fixing base 70*b* relative to an end of the free front end 50*b*. Specifically, the fixing base 70*b* includes a first fixing base 71*b* and a second fixing base 72*b* that are sequentially arranged from the inside to the outside in a radial direction of the susceptor 50*b*; and the first fixing base 71*b* is preferably made of ceramics with low heat conductivity such as zirconia, and the second fixing base 72*b* is preferably made of organic polymers with low heat conductivity such as PEEK.

In terms of the design of the inhaling airflow, further, refer to FIG. 21 to FIG. 24, a first air inlet 151*b* is provided on the second housing 15*b*; and in terms of specific position arrangement, the first air inlet 151*b* is located at a position at which the second housing 15*b* is adjacent to the first housing 10*b*, and is also adjacent to a position at which the operating portion 410*b* of the extractor 40*b* is joined to the first housing 10*b*. After assembly, when being kept in the second housing 15*b*, the operating portion 410*b* covers the first air inlet 151*b*, and may expose the first air inlet 151*b* when the aerosol-generating product A is extracted by operations such as removal/movement to the extraction position. At the operating position, there is a joining gap of approximately 2 mm between the operating portion 410*b* of the extractor 40*b* and the first housing 10*b*, and the first air inlet 151*b* is opposite to and in airflow communication with the gap. In an inhaling process, the external air enters the first air inlet 151*b* through the joining gap between the operating portion 410*b* and the first housing 10*b*.

The bracket 20*b* further has an inner bottom wall 221*b* defining the accommodating space 210*b*; and there is a distance or gap approximately ranging from 1 mm to 3 mm between the inner bottom wall 221*b* and the fixing base 70*b* of the susceptor 50*b*, and the inner bottom wall 221*b* further has a second air port 222*b*. In an implementation, the second air port 222*b* is opposite to the second hole 423*b* on the extractor 40*b*.

During inhalation, as shown by the arrow R2 in the figure, the external air enters the first air inlet 151*b* through the joining gap between the operating portion 410*b* and the first housing 10*b*, flows from the first air inlet 151*b* in the radial direction to the second air port 222*b* through the gap between the bottom wall 221*b* and the fixing base 70*b*, and finally enters the aerosol-generating product A from the second air port 222*b* through the second hole 423*b* on the extractor 40*b* and is then inhaled.

It may be learnt from the figure that an airflow path includes an air inlet portion extending from the first air inlet 151*b* to the second air port 222*b* basically in a radial direction of the susceptor 50*b*; and an air outlet portion extending from the second air port 222*b* in a length direction to the near end 110*b*. Basically, the air inlet portion is basically vertical to the air outlet portion. Certainly, in an implementation, the air outlet portion passes through the accommodating space 210*b* and/or the receiving portion 420*b* of the extractor 40*b*.

Further, in a more preferred implementation, as shown in FIG. 24, the second fixing base 72*b* has a latching protrusion 721*b* extending into the first air inlet 151*b*, and the second housing 15*b* is kept by the latching protrusion 721*b* in the first air inlet 151*b*; and when disassembly is required, the latching protrusion 721*b* may be pressed to detach from the first air inlet 151*b*, so that the second housing 15*b* is disassembled or removed from the first housing 10*b*.

It should be noted that, the specification of this application and the accompanying drawings thereof illustrate preferred embodiments of this application, but this application is not limited to the embodiments described in the specification. Further, a person of ordinary skill in the art may make improvements or variations according to the foregoing descriptions, and such improvements and variations shall all fall within the protection scope of the appended claims of this application.

The invention claimed is:

1. An aerosol-generation device, configured to heat an aerosol-generating product to generate an aerosol, comprising:

a receiving cavity, configured to receive the aerosol-generating product;

a heater, at least partially extending in the receiving cavity, to heat the aerosol-generating product, wherein the heater has a free front end configured to be inserted into the aerosol-generating product; and a window, at least partially surrounding the heater and avoiding the free front end, to cause the heater to have an exposed portion exposed through the window, wherein a user cleans the exposed portion of the heater through the window;

wherein the aerosol-generation device further comprises a door cover movably coupled to the aerosol-generation device at a first position and a second position, the door cover covering the window at the first position and exposing the window at the second position; and wherein the door cover simultaneously covers the window and the receiving cavity at the first position, and simultaneously exposes the window and the receiving cavity at the second position.

2. The aerosol-generation device according to claim 1, further comprising:

a fixing base, configured to keep the heater, wherein the exposed portion is adjacent to or terminates at the fixing base.

3. The aerosol-generation device according to claim 1, wherein the exposed portion of the heater is located outside the receiving cavity.

4. The aerosol-generation device according to claim 1, further comprising:

a bracket, at least partially defining the window; and a blocking member, configured to block the window;

wherein the blocking member is removably combined with the bracket, blocks the window when combined with the bracket, and exposes the window when removed from the bracket.

5. The aerosol-generation device according to claim 4, wherein the blocking member is configured to be removable from the bracket in a width direction of the aerosol-generation device.

6. The aerosol-generation device according to claim 4, wherein the blocking member comprises:

a main body portion, configured to be removably combined with the bracket; and at least one blocking arm, extending from the main body portion in a width direction of the aerosol-generation device, and configured to cover the window.

7. The aerosol-generation device according to claim 6, wherein the bracket has a recessed portion, and the main body portion is further combined with the bracket after being accommodated in the recessed portion.

8. The aerosol-generation device according to claim 6, wherein a first magnetic member is arranged on the bracket; and a second magnetic member is arranged on the main body portion, to be magnetically attracted to the first magnetic member when the blocking member is combined with the bracket wherein the aerosol-generation device further comprises:

an extractor, selectively configurable from an operating position to an extraction position, and configured to extract the aerosol-generating product, wherein the aerosol-generating product is in contact with the heater when the extractor is at the operating position, and the aerosol-generating product is separated from the heater when the extractor is at the extraction position;

a third magnetic member is arranged on the extractor, and is configured to be magnetically attached to the first magnetic member at the operating position; and in a length direction of the aerosol-generation device, a magnetic pole direction of the first magnetic member, a magnetic pole direction of the second magnetic member, and a magnetic pole direction of the third magnetic member are the same.

9. The aerosol-generation device according to claim 4, further comprising:

an electric core, wherein an extending length thereof in a length direction of the aerosol-generation device at least partially coincides with the heater; and a cavity, located between the electric core and the heater in a width direction of the aerosol-generation device, to reduce heat transferred from the heater to the electric core.

10. The aerosol-generation device according to claim 9, wherein the bracket comprises: an inner wall, at least partially surrounding the heater; and an outer side wall, adjacent to the electric core, wherein the cavity is formed between the inner wall and the outer side wall of the bracket.

11. The aerosol-generation device according to claim 4, wherein the bracket is configured to be removable from the aerosol-generation device, to basically completely expose the heater.

12. The aerosol-generation device according to claim 1, further comprising:

a bracket, at least partially defining the window; and a blocking member, configured to block the window;

wherein the blocking member is movably combined with the bracket, and is configured to selectively block or expose the window through movement.

13. The aerosol-generation device according to claim 1, wherein the receiving cavity is in airflow communication with the window, so that external air enters the receiving cavity through the window during inhalation.

14. The aerosol-generation device according to claim 1, further comprising:

an extractor, selectively configurable from an operating position to an extraction position, and configured to extract the aerosol-generating product, wherein the aerosol-generating product is in contact with the heater when the extractor is at the operating position, and the aerosol-generating product is separated from the heater when the extractor is at the extraction position;

the extractor is at least partially exposed through the window at the operating position.

15. The aerosol-generation device according to claim 1, further comprising:

an extractor, selectively configurable from an operating position to an extraction position, and configured to extract the aerosol-generating product, wherein the aerosol-generating product is in contact with the heater when the extractor is at the operating position, and the aerosol-generating product is separated from the heater when the extractor is at the extraction position; and the extractor covers the exposed portion of the heater at the operating position.

16. An aerosol-generation device, configured to heat an aerosol-generating product to generate an aerosol, comprising:

a receiving cavity, configured to receive the aerosol-generating product;

a heater, at least partially extending in the receiving cavity, to heat the aerosol-generating product, wherein the heater has a free front end configured to be inserted into the aerosol-generating product; and a window, at least partially surrounding the heater and avoiding the free front end, wherein at least a part of the heater facing away from the free front end is visible through the window;

wherein the aerosol-generation device further comprises a door cover movably coupled to the aerosol-generation device at a first position and a second position, the door cover covering the window at the first position and exposing the window at the second position; and wherein the door cover simultaneously covers the window and the receiving cavity at the first position, and simultaneously exposes the window and the receiving cavity at the second position.

17. An aerosol-generation device, configured to heat an aerosol-generating product to generate an aerosol, comprising:

a receiving cavity, configured to receive the aerosol-generating product;

a heater, at least partially extending in the receiving cavity, to heat the aerosol-generating product, wherein the heater has a free front end configured to be inserted into the aerosol-generating product; and a window, at least partially surrounding the heater and avoiding the free front end, wherein the window is configured as an air inlet for air to enter the receiving cavity during use;

wherein the aerosol-generation device further comprises a door cover movably coupled to the aerosol-generation device at a first position and a second position, the door cover covering the window at the first position and exposing the window at the second position; and wherein the door cover simultaneously covers the window and the receiving cavity at the first position, and simultaneously exposes the window and the receiving cavity at the second position.

* * * * *